US008389460B2

(12) United States Patent
Arai et al.

(10) Patent No.: US 8,389,460 B2
(45) Date of Patent: Mar. 5, 2013

(54) CLOTHES WASHING METHOD AND SURFACTANT-FREE DETERGENT COMPOSITION USED FOR THE SAME

(75) Inventors: Kazuyoshi Arai, Kanagawa-ken (JP); Tomoki Seo, Kanagawa-ken (JP); Ryousuke Kurokawa, Kanagawa-ken (JP)

(73) Assignee: Miz Co., Ltd., Kanagawa-Ken (JP)

( * ) Notice: Subject to any disclaimer, the term of this patent is extended or adjusted under 35 U.S.C. 154(b) by 941 days.

(21) Appl. No.: 11/994,360

(22) PCT Filed: Jul. 3, 2006

(86) PCT No.: PCT/JP2006/313249

§ 371 (c)(1),
(2), (4) Date: Dec. 31, 2007

(87) PCT Pub. No.: WO2007/004622

PCT Pub. Date: Jan. 11, 2007

(65) Prior Publication Data

US 2009/0119847 A1 May 14, 2009

(30) Foreign Application Priority Data

Jul. 1, 2005 (JP) ..... 2005-194266

(51) Int. Cl.
*C11D 7/00* (2006.01)
*C11D 7/12* (2006.01)
*C11D 7/14* (2006.01)

(52) U.S. Cl. ..... 510/400; 510/276; 510/299; 510/300; 510/309; 510/367; 510/374; 510/470; 510/471; 510/478; 510/477; 510/480; 510/509; 510/511

(58) Field of Classification Search ..... 510/400, 510/276, 299, 300, 309, 367, 374, 470, 471, 510/477, 478, 480, 509, 511
See application file for complete search history.

(56) References Cited

U.S. PATENT DOCUMENTS

| | | | | |
|---|---|---|---|---|
| 3,655,568 | A * | 4/1972 | Zaki et al. | 510/374 |
| 5,002,682 | A * | 3/1991 | Bragg et al. | 510/311 |
| 5,961,662 | A | 10/1999 | Yamaguchi et al. | |
| 6,200,351 | B1 * | 3/2001 | Schleinig et al. | 8/115.6 |
| 6,284,722 | B1 | 9/2001 | Yamaguchi et al. | |
| 7,091,171 | B2 * | 8/2006 | Caswell et al. | 510/439 |
| 7,407,924 | B2 * | 8/2008 | Arai et al. | 510/400 |
| 7,553,807 | B2 * | 6/2009 | Arai et al. | 510/400 |
| 2004/0082490 | A1 * | 4/2004 | Arai et al. | 510/276 |
| 2005/0036975 | A1 * | 2/2005 | Heike et al. | 424/73 |
| 2008/0000503 | A1 * | 1/2008 | Hammock | 134/42 |
| 2010/0210503 | A1 * | 8/2010 | Hammock | 510/401 |

FOREIGN PATENT DOCUMENTS

| | | |
|---|---|---|
| EP | 0 892 043 | 1/1999 |
| EP | 1 340 805 | 9/2003 |
| JP | 56-151799 | 11/1981 |
| JP | 63-20397 | 1/1988 |
| JP | 7-278597 | 10/1995 |
| JP | 9-87678 | 3/1997 |
| JP | 9-132794 | 5/1997 |
| JP | 11-256192 | 9/1999 |
| JP | 2004-2869 | 1/2004 |
| JP | 2004-175871 | 6/2004 |
| WO | 97/33970 | 9/1997 |

OTHER PUBLICATIONS

English language Abstract of JP 2004-2869.
English language Abstract of JP 2004-175871.
English language Abstract of JP 7-278597.
English language Abstract of JP 9-87678.
English language Abstract of JP 11-256192.
English language Abstract of JP 9-132794.
An Abstract of JP 3481615 B2, Dec. 22, 2003.

* cited by examiner

*Primary Examiner* — Charles I Boyer
(74) *Attorney, Agent, or Firm* — Greenblum & Bernstein, P.L.C.

(57) ABSTRACT

The present invention washes clothes using a phosphorous-free detergent composition for clothes, which contains an organic alkaline chelating agent as an essential ingredient, and an anti-soil redeposition agent, but no surfactant.

10 Claims, No Drawings

CLOTHES WASHING METHOD AND SURFACTANT-FREE DETERGENT COMPOSITION USED FOR THE SAME

TECHNICAL FIELD

The present invention relates to a clothes washing method for washing clothes using an organic chelating agent as a main component for detergency, and a detergent composition used for the same.

BACKGROUND ART

Due to superior detergency and good usability, synthetic detergents in the washing of clothes have gained overwhelming support. However, not all of the gains to consumers from synthetic detergents are positive. For example, issues have recently begun to be raised regarding adverse affects on aquatic organisms from synthetic detergents including the possibility of being an endocrine disrupting chemical. Also, the fact cannot be escaped that a substantial amount of surfactant included in synthetic detergents remains on clothes despite repetitive and careful rinsing, nor may the probability be denied that such surfactant passes through the skin to bring about any number of affects on the human body.

While excellent washing performance through the surfactant is widely acknowledged, appearance of a new detergent having no added surfactant, yet having the same or greater washing performance and usability as synthetic detergents has been awaited when considering the adverse affects on organisms and the environment.

With this technical background, the applicant of the present invention proposes a detergent composition and a washing method using the same; wherein the detergent composition does not effectively use surfactant, has the same or greater washing performance and usability as conventional synthetic detergents that use a surfactant as a main component for detergency, and uses an alkaline buffer as the main component for detergency (Patent Reference 1).

However, the invention of Patent Reference 1 does not disclose or even suggest to the effect of using an organic chelating agent as the main component for detergency. Furthermore, the invention of Patent Reference 1 is completely different from the present invention, which uses an organic chelating agent as the main component for detergency, even in view of the fact that Patent Reference 1 describes to the effect of almost contradicting combination with the organic chelating agent in paragraph 0043 of the patent specification, saying 'In this manner, since the principle component of this detergent reacts with hardness components, which are detergency constraints, and destroys them, a useful water-softening effect may be acquired without particularly adding an organic chelating agent, normally used as a synthetic detergent component, and a water-softening agent such as water-insoluble zeolite.'

Furthermore, Patent Reference 2 describes to the effect of washing clothes under specific high-alkali, low hardness washing conditions for the purpose of providing a washing method with low surfactant concentration and excellent detergency.

However, Patent Reference 2 merely discloses a washing method assuming use of a surfactant, and does not disclose or even suggest to the effect of washing using a washing liquid not including a surfactant as with the present invention.

Patent Reference 1: Japanese Patent Publication No. 3481615
Patent Reference 2: Japanese Unexamined Patent Application Publication No. Hei 9-132794

An objective of the present invention is to provide a detergent composition and a washing method using the same; wherein the detergent composition does not use surfactant that is questionable in terms of safeness on the human body and reduction in environmental burden, and uses an organic chelating agent as the main component for detergency, allowing the same or greater washing performance and usability as the synthetic detergents that use a conventional surfactant as the main component for detergency.

DISCLOSURE OF INVENTION

In consideration of the above-given objective, the inventors of the present invention have turned their attention to improving a detergent that uses the alkaline buffer according to Patent Reference 1 as a main component for detergency, and have found dramatic improvement in washing performance when combining a certain type of organic chelating agent to the detergent, and as a result of intensive studies on said organic chelating agent, they have reached the idea that deactivating (inactivating) hardness components (may be referred to as 'multivalent cations' hereafter) in a washing liquid as much as possible is extremely important for improving washing performance for clothes.

In other words, to explain the washing mechanism, force to attract a substrate (an article of clothing) and soil is almost completely due to a weak electrostatic force including intermolecular force. If negative zeta potential of both of the substrate and the soil can be increased to increase each other's repulsion in the washing liquid, making the soil break away from the substrate should then be relatively easy by mechanical force.

However, the multivalent cations (hardness components), such as calcium ions and magnesium ions, in the washing liquid attract both the substrate and the soil, the surfaces of which are negatively charged, because they work as a bridge (namely, a multivalent cation bridge) within the washing liquid, thereby inhibiting the soil from breaking away from the substrate.

The present inventors have focused on this point, which lead to a thought that it is essential to attain high deactivation of the hardness components in the washing liquid so as to improve washing performance for clothes.

As dedicated development progresses along this line of thought, the present inventors have come to know the real condition that hardness components in the washing liquid are not only included in the washing water, but those attached to clothes, soil, and washing tub also come out into the washing liquid during the washing process, where hardness components including all of these are factors causing decrease in detergency.

Thus, composition thereof and an anti-soil redeposition agent are studied and a little additive is also considered for the purpose of eliminating said factors for detergency and obtaining an organic chelating agent detergent composition capable of securing the detergency in demand from the market. As a result, the same or greater washing performance and usability as with conventional synthetic detergents that use a surfactant as a main component for detergency can be obtained without use of any surfactant, and a detergent composition using an organic chelating agent as the main component for detergency and a washing method using the same may be provided, finally completing the present invention.

(1-1) Organic Chelating Agent

The organic chelating agent as the most important component in the present invention plays the role of a main component for detergency in the present invention through a mechanism of destroying hardness components within a washing liquid by chemically bonding to a multivalent cation (hardness component) to form a metal ion complex, and favorably satisfies conditions of a) fast chelating speed, b) high chelating ability, c) chelate stability, d) high security, e) good biodegradability, and f) good solubility.

To give examples of available substances as the organic chelating agent according to the present invention, sodium salt of organic carboxylic acid such as oxalic acid (OA), citric acid (CA), tartaric acid (TA), or gluconic acid (GA), a hydroxyamino carboxylic acid chelating agent, which is sodium salt of N-(2-hydroxylethyl) glycine (DEG), triethanolamine (TEA), N-(2-hydroxyethyl) iminodiacetic acid (HEIDA), or N-(hydroxyethyl)ethylenediamine tetraacetic acid (HEDTA), an ether carboxylic acid chelating agent, which is sodium salt of O-carboxymethyltartronic acid (CMT) or O-carboxymethylsuccinic acid (CMOS), a vinyl polyelectrolyte chelating agent, which is sodium salt of a copolymer of acrylic acid/maleic acid and polyacrylic acid, or a carboxylic acid chelating agent, which is sodium salt of Nitrilo Triacetic Acid (NTA), Diethylene Triamine Pentaacetic Acid (DTPA), Hydroxyethyl Ethylene Diamine Triacetic Acid (HEDTA), Ethylene Diamine Tetraacetic Acid (EDTA), MethyleGlycineDiacetic Acid (MGDA), DicarboxymethyleGlumatic Acid (GLDA), Aspartate Diacetic Acid (ASDA), Ethylenediamine Disuccinic Acid (EDDS), Hydroxye Iminodisuccinic Acid (HIDS), or Iminodisuccinic Acid (IDS) are preferably used. Of these, MGDA, GLDA, ASDA, EDDS, HIDS, and IDS with good biodegradability are preferred in terms of environmental burden.

Note that organic chelating agent according to the present invention is a concept including both such abovementioned organic chelating agent to be used alone and a combination of multiple organic chelating agents to be used.

Some of quantitative conditions for when selecting an appropriate organic chelating agent for use in the present invention are i) pH of a 1% aqueous chelating agent solution is 9 or greater, preferably within a range of 10 and 12.5, and ii) maximum calcium trapping ability (number of milligrams of $CaCO_3$ per gram for pH 11) is 200 mg/g or greater, preferably 300 mg/g or greater.

Particularly, an organic alkaline chelating agent such as tetrasodium ethylene diamine tetraacetic acid (may be referred to as "EDTA-4Na" hereafter): Trilon B powder (registered trademark, manufactured by BASF Corporation), or trisodium methylglycinediacetic acid (may be referred to as "MGDA-3Na" hereafter): Trilon M powder (registered trademark, manufactured by BASF Corporation) may be given as an example of a substance satisfying such quantitative conditions. For comparison, with EDTA-4Na, the pH of a 1% aqueous EDTA-4Na solution is 10.5 to 12.5 and maximum calcium trapping ability is 225 mg/g, and with MGDA-3Na, the pH of a 1% aqueous MGDA-3Na solution is 10.5 to 12.5 and maximum calcium trapping ability is 327 mg/g.

(1-2) Detergency of Organic Alkaline Chelating Agent

Since both EDTA-4Na and MGDA-3Na have a chelating action and an alkaline buffer action in one, one substance takes on two roles as an organic chelating agent and an alkaline buffer. Therefore, each of EDTA-4Na and MGDA-3Na is dissolved into washing water while changing the concentrations thereof, thereby providing multiple washing liquids of different concentrations, and washing results for respective washing liquids provided are then studied. Note that in this detergency test, for the purpose of assessing the fundamental ability of the organic alkaline chelating agent, only the chelating agent is employed as a substance to be tested, and neither the anti-soil redeposition agent according to the present invention nor other additives are blended therein.

Here, when multiple washing liquids of different concentrations are obtained by dissolving each of EDTA-4Na and MGDA-3Na into washing water while changing the concentrations thereof, pHs among the multiple washing liquids of different concentrations change, and chelating ability and stability change in accordance with the change in pH. Thus, even if detergency is compared among the aforementioned multiple washing liquids of different concentrations, it is difficult to study whether blend of the chelating agent contributes to improvement in detergency. Therefore, in order to eliminate this problem, pH thereof is adjusted so as to be constant (pH 11) by adding sodium hydroxide to the above-given respective washing liquids.

Test conditions are as follows.

(Test Conditions)

A tergotometer is used to carry out a 10 minute wash cycle at a rotation speed of 120 rpm with 1 liter of 30 degrees Celsius washing water using substances and detergent concentrations given in Table 1, and two rinse cycles. The washing water is water of a hardness 90 ppm obtained by dissolving calcium chloride dihydrate in purified water, providing a concentration of 133 mg/L. Water obtained through such procedure is hereafter called Japanese standard washing water.

(Stained Fabric)

Wet-type artificially stained fabrics (manufactured by the Laundry Research Association) stained with synthetic sebum are used.

(Calculation of Detergency Ratio)

Detergency ratio is calculated by the following expression.

Detergency ratio(%)=(whiteness index of stained fabric after washing−whiteness index of stained fabric before washing)+(whiteness index of unstained fabric−whiteness index of stained fabric before washing)×100

Whiteness index is found by measuring ten points on both sides of the respective stained fabrics using a whiteness tester (manufactured by Minolta Co., Ltd., CR-14, Whiteness Index Color Reader), and then averaging these measured values.

Washing results for the respective washing liquids of different concentrations when EDTA-4Na is dissolved into the Japanese standard washing water while changing the concentration thereof are given in Table 1.

[Table 1]

TABLE 1

| EDTA-4Na (g/LITER) | DETERGENCY (%) ARTIFICIALLY STAINED FABRIC |
|---|---|
| 0 | 16.8 |
| 0.17 | 18.0 |
| 0.33 | 22.0 |
| 0.40 | 32.7 |
| 0.43 | 48.4 |
| 0.47 | 59.5 |
| 0.50 | 61.1 |
| 0.67 | 59.9 |
| 0.83 | 57.9 |
| 1 | 58.9 |

The maximum calcium trapping ability of EDTA-4Na is 225 mg/g for pH 11, and a calculated value for a necessary amount (necessary concentration) of EDTA-4Na to completely destroy the hardness components included in the Japanese standard washing water (includes 90 mg/L hardness components) is provided by the following expression.

Hardness of washing water/maximum calcium trapping ability of chelating agent used=90/225=0.4 g/L As it may be clearly seen by comparing the test results in Table 1 and the above-given calculated value, the detergency begins to rise suddenly from around the concentration of 0.4 g/L or the calculated value (detergency ratio at this time is 32.7%), and peaks around the concentration of 0.47 g/L (detergency ratio at this time is 59.5%). In that connection, as described later, since the detergency ratio of the wet-type artificially stained fabrics is approximately 50% when washing using a washing liquid (Attack Bio Enzymes, detergent concentration 0.67 g/L, manufactured by Kao Corporation, fluorescent brightening agent included) obtained by dissolving a commercially available powdered synthetic detergent into the Japanese standard washing water at a standard concentration, it may be seen that the detergency due to using EDTA-4Na alone is equivalent to or greater than that of the commercially available powdered synthetic detergent within the range exceeding a concentration of 0.43 g/L (detergency ratio at this time is 48.4%). More specifically, it is greater than the detergency (approximately 50%) of the commercially available powdered synthetic detergent within the range exceeding a concentration of 0.47 g/L (detergency ratio at this time is 59.5%).

Next, washing results for the respective washing liquids of different concentrations when MGDA-3Na is dissolved into the Japanese standard washing water while changing the concentration thereof are given in Table 2.

[Table 2]

TABLE 2

| MGDA-3Na (g/LITER) | DETERGENCY (%) ARTIFICALLY STAINED FABRIC |
|---|---|
| 0 | 18.0 |
| 0.17 | 19.9 |
| 0.23 | 21.9 |
| 0.27 | 25.7 |
| 0.30 | 38.1 |
| 0.33 | 52.2 |
| 0.37 | 59.9 |
| 0.40 | 62.7 |
| 0.50 | 60.5 |
| 0.67 | 59.7 |
| 1 | 59.6 |

The maximum calcium trapping ability of MGDA-3Na is 327 mg/g for pH 11, and a calculated value for a necessary amount (necessary concentration) of EDTA-3Na to completely destroy the hardness components included in the Japanese standard washing water (includes 90 mg/L hardness components) is provided by the following expression.

Hardness of washing water/maximum calcium trapping ability of chelating agent used=90/327=0.275 g/L As it may be seen by comparing the test results in Table 2 and the above-given calculated value, the detergency begins to rise suddenly from around the concentration of 0.275 g/L or the calculated value (detergency ratio at this time is 25.7%), and peaks around the concentration of 0.37 g/L (detergency ratio at this time is 59.9%). In that connection, as described above, since the detergency ratio of the wet-type artificially stained fabrics is approximately 50% when washing using a washing liquid obtained by dissolving a commercially available powdered synthetic detergent into the Japanese standard washing water at a standard concentration, it may be seen that the detergency due to using MGDA-3Na alone is equivalent to or greater than that of the commercially available powdered synthetic detergent within the range exceeding a concentration of 0.33 g/L (detergency ratio at this time is 52.2%). More specifically, it is greater than the detergency (approximately 50%) of the commercially available powdered synthetic detergent within the range exceeding a concentration of 0.37 g/L (detergency ratio at this time is 59.9%). Further, least possible concentration to obtain the same detergency (50%) as the commercially available powdered synthetic detergent is a concentration of 0.43 g/L (detergency ratio at this time is 48.4%) for use of EDTA-4Na alone, and 0.33 g/L (detergency ratio at this time is 52.2%) for use of MGDA-3Na alone. Accordingly, use of MGDA-3Na alone may obtain a detergency equivalent to or greater than that of the commercially available powdered synthetic detergent using a smaller amount than in the case of using EDTA-4Na alone.

(2) Alkaline Buffer

The alkaline buffer according to the present invention is a buffer including a pH buffer action salt, such as alkali metal bicarbonate salt, alkali metal borate salt, or alkali metal phosphate salt, and an alkali action salt, such as alkali metal silicate salt or alkali metal carbonate salt, as main components, which are disclosed in U.S. Pat. No. 3,481,615, which is filed earlier by the applicant of the present invention and already registered as a patent and is incorporated herein by reference.

Of these, crystalline layered sodium silicate alone or a mixture of crystalline layered sodium silicate and sodium hydrogen carbonate is particularly preferably used.

The action of the alkaline buffer is to converge to and maintain the pH of the washing liquid between 9 and 11, which is a weak alkalescent range suitable for washing in terms of detergency, chelation speed, chelate stability, and the like, preferably 10 to 11, even when an external factor, such as soil with acidity, mixes into the washing liquid and tries to vary the pH of the washing liquid. By maintaining such alkaline washing environment, the organic chelating agent according to the present invention may freely exhibit a hardness component trapping ability. This is one of washing conditions that the washing liquid should satisfy at the time clothing is put therein.

Of the alkaline buffers, particularly crystalline layered alkali metal silicate salt (crystalline layered sodium silicate) includes a hardness component trapping ability (ion exchanging ability) as well as the aforementioned alkalescency and alkaline buffer action, and may be preferably used for the purpose of supplementing the hardness component trapping ability exhibited by the organic chelating agent according to the present invention. Therefore, when there is a request for reducing the blend of organic substances in the detergent composition of the present invention, a part of the organic chelating agent should be displaced by an alkaline buffer, more specifically crystalline layered alkali metal silicate salt (crystalline layered sodium silicate) and blended therein, considering securing a detergency (for example, approximately 40% of the Japanese standard detergent, which is detergency of a wet-type artificially stained fabric of a first detergency test described later, preferably approximately 50% of the commercially available powdered synthetic detergent) requested by the market.

Note that when blending the organic alkaline chelating agent into the detergent composition of the present invention, blend of an alkaline buffer may be omitted. In this case, the organic alkaline chelating agent takes on the roles of both chelating agent and alkaline buffer.

(3) Anti-Soil Redeposition Agent (Anti-Soil Redeposition Action Component)

As the anti-soil redeposition agent according to the present invention, a nonionic water-soluble polymer such as methylcellulose, hydroxypropylcellulose, hydroxypropyl methylcellulose, hydroxyethyl methylcellulose, or partial saponification type polyvinyl alcohol is preferably used, as disclosed in U.S. Pat. No. 3,481,615, which is filed earlier by the applicant of the present invention and already registered as a patent and is incorporated herein by reference.

More specifically, of these, a mixture of the partial saponification type polyvinyl alcohol and carboxymethylcellulose is preferably used.

The function of the anti-soil redeposition agent is to inhibit redeposition on both hydrophilic fabrics and hydrophobic fabrics by reducing the surface tension mainly increased by the washing liquid to 0.058 N/m or less.

(4) Detergent Composition for Clothes and Washing Liquid for the Same

The detergent composition for clothes according to the present invention is phosphate-free detergent composition for clothes having an organic alkaline chelating agent as an essential component, and further including an anti-soil redeposition agent but having no surfactant, or a phosphate-free detergent composition for clothes including an organic chelating agent, an alkaline buffer, and an anti-soil redeposition agent but having no surfactant.

This derives from the fact that when assuming an actual washing situation, tolerance of differences in various washing environments such as 'Is hardness of the washing water soft or hard?', 'Is type of washing machine used pulsator-type, drum-type, or agitation-type?', amount of clothing to be washed, and type and degree of soil is requested, and that considering such request, using an organic chelating agent as an essential component, and further including an anti-soil redeposition agent, or using the organic alkaline chelating agent, the alkaline buffer, and the anti-soil redeposition agent as essential components of the detergent composition for clothes is preferable in terms of composition design.

A sequestering agent is effective for destroying the hardness components in the washing liquid; however, the organic chelating agent, which has a function of destroying hardness components within the washing liquid by chemically bonding with metal ions in the washing liquid to form a metal ion complex, is given the status of most important component of the present invention.

An ion exchanger (e.g., alminosiliate or crystalline layered alkali metal silicate salt), aside from the organic chelating agent, is used as a sequestering agent for when washing; however, in the case of an ion exchanger, since ion exchange is conducted in accordance with difference in concentration of the metal ions in the washing liquid, there is a fundamental problem that the difference in concentration cannot cause reduction of the metal ions in the washing liquid down to no greater than concentration in an equilibrium state.

Meanwhile, with the aim of obtaining high washing performance, maintaining a state in which almost all of the hardness components in the washing liquid are destroyed (hardness of washing liquid is 10 ppm or less), preferably maintaining a state in which the hardness components in the washing liquid are completely destroyed (hardness of washing liquid is 0 ppm or less), further preferably maintaining a state of completely destroying hardness components in the washing liquid and reserving capacity to further destroy (state in which hardness of washing liquid is 0 ppm or less, and there is a surplus of substances capable of trapping and destroying hardness components in the washing liquid) from beginning to end of washing is extremely important.

From such viewpoint, with the present invention, a washing liquid satisfying 'pH of the washing liquid is 9 to 11 (preferably pH of 10 to 11), and more than enough of a substance capable of trapping and destroying hardness components within the washing liquid exists in the washing liquid such that almost all of the hardness components are destroyed' as washing conditions at the time clothing is put therein.

Here, 'pH of the washing liquid is 9 to 11 (preferably pH of 10 to 11), and more than enough of a substance capable of trapping and destroying hardness components within the washing liquid exists in the washing liquid such that almost all of the hardness components are destroyed' means maintaining the pH of the washing liquid within a range of 9 to 11, which calls forth the fundamental function of the organic chelating agent to trap hardness components, and maintaining a state in which almost all of the hardness components in the washing liquid are destroyed (hardness of washing liquid is 10 ppm or less) from beginning to end of washing as washing conditions.

Furthermore, according to a preferred embodiment of the present invention corresponding to 'maintaining a state in which almost all of the hardness components in the washing liquid are destroyed (hardness of washing liquid is 10 ppm or less) from beginning to end of washing', a substance capable of trapping and destroying hardness components within the washing liquid assumes to be a mixture of the organic chelating agent and the crystalline layered alkali metal silicate salt (crystalline layered sodium silicate) of the alkaline buffers.

Of these, due to difference in how to use the organic chelating agent, two more aspects of the present invention exist. In other words, according to a first aspect, the organic chelating agent (substance capable of trapping hardness components within the washing liquid) in the washing liquid when no clothes are put therein cannot completely destroy the hardness components in the washing liquid, but more than enough to almost destroy the hardness components (hardness of the washing liquid may be set to 10 ppm or less) exists therein. According to a second aspect, more than enough of the organic chelating agent (substance capable of trapping hardness components within the washing liquid) in the washing liquid when no clothes are put therein can completely destroy the hardness components in the washing liquid (hardness of the washing liquid may be set to 0 ppm or less).

According to the above-given first aspect, usage amount of the organic chelating agent falls below the calculated value for a necessary amount of the organic chelating agent to completely destroy the hardness components included in the washing water. In this case, with the aim to supplement the hardness component trapping function of the organic chelating agent, a relatively large amount of crystalline layered alkali metal silicate salt (crystalline layered sodium silicate) is used. Note that in working examples of detergency tests described later. Working Example 14 corresponds to this first aspect.

Meanwhile, according to the above-given second aspect, usage amount of the organic chelating agent is equivalent to or greater than the calculated value for a necessary amount of the organic chelating agent to completely destroy the hardness components included in the washing water. In this case, with the aim to supplement the hardness component trapping function of the organic chelating agent, less crystalline layered alkali metal silicate salt (crystalline layered sodium silicate) than in the first aspect is used. Note that in working examples of detergency tests described later, Working Examples except 3, 8, 13, 14, and 19 correspond to this second aspect. Furthermore, the usage amount of the organic chelating agent in the second aspect may be found by the following expression using hardness and amount of washing water, and chelating ability of the organic chelating agent maximum capability of trapping calcium) to be used.

Hardness of washing water/chelating ability of the organic chelating agent(maximum calcium trapping ability)used×amount of washing water Furthermore, with the present invention, aiming to further improve washing performance, a washing liquid satisfying 'pH of the washing liquid is 9 to 11 (preferably pH of 10 to 11), and more than enough of a substance capable of trapping and destroying hardness components within the washing liquid exists in the washing liquid such that almost all of the hardness components are destroyed' as washing conditions when clothing is put therein is used.

Here, 'pH of the washing liquid is 9 to 11, and more than enough of a substance capable of trapping and destroying hardness components within the washing liquid exists in the washing liquid such that almost all of the hardness components are destroyed' means maintaining the pH of the washing liquid in a range of 9 to 11, which calls forth the fundamental function of the organic chelating agent to trap hardness components, and maintaining a state in which the hardness components in the washing liquid are completely destroyed (hardness of washing liquid is 0 ppm or less), preferably maintaining a state of completely destroying hardness components in the washing liquid and reserving capacity to further destroy (state in which hardness of washing liquid is 0 ppm or less, and a surplus of substances capable of trapping and destroying the hardness components in the washing liquid) from beginning to end of washing as washing conditions.

According to a preferred embodiment of the present invention corresponding to 'maintaining a state of completely destroying hardness components in the washing liquid (hardness of washing liquid is 0 ppm or less), preferably maintaining a state of completely destroying hardness components in the washing liquid and reserving capacity to further destroy (state in which hardness of washing liquid is 0 ppm or less, and a surplus amount of substances capable of trapping and destroying the hardness components in the washing liquid) from beginning to end of washing', a substance capable of trapping hardness components for destroying hardness components within the washing liquid assumes to be the organic chelating agent alone (in working examples of detergency tests described later, Working Examples 3, 8, 13, and 19 correspond to this aspect of the present invention), or a mixture of the organic chelating agent and the crystalline layered alkali metal silicate salt (crystalline layered sodium silicate) of the alkaline buffers.

According to the present invention, washing may be conducted in an ideal washing environment in which detergency impairing factors, which derive from a so-called multivalent cation bridge, are eliminated taking into consideration all variable factors of the washing environment such as total amount of multivalent cations including those included in the washing water, those extracted from clothes, and those extracted from soil-stained clothes, 'Is type of washing machine used pulsator-type, drum-type, or agitation-type?', amount of clothing to be washed, and type and degree of soil, namely using a completely softened washing liquid. As a result, high washing performance may be obtained.

(5) Concept of Detergent Composition for Clothes and Usage Concentration

How to set the detergent composition for clothes and standard usage amount is a problem when proposing the above-given detergent composition for clothes to the market.

Since detergent composition for clothes and standard usage amount when washing clothes significantly depends on hardness of washing water, detergent composition for clothes and standard usage amount must be made to differ from country to country. For example, while water of a hardness near 70 ppm is typically used in Japan, water of a hardness of 110 ppm or greater is used in the United States, and that exceeding 180 ppm is used in Europe as washing water in actuality. Therefore, necessary amount of the organic chelating agent varies, and the standard usage amount must be adjusted in accordance with the hardness of the washing water.

With the present invention, by dividing into A) a region of a small low hardness range (approximately 0 to 120 ppm) and B) a region of a large high hardness range (120 to 350 ppm or greater), for example, and setting the standard usage amount for each region, the aforementioned problem arising from differences in washing conditions due to change in hardness of washing water is absorbed.

The case of the former region A should be accommodated by setting the detergent composition for clothes and standard usage amount using the Japanese standard washing water of hardness 90 ppm while case of the very limited high hardness region should be accommodated by appropriately increasing the usage amount.

The case of the latter region B should be accommodated by assuming a hardness classification type II (125 to 250 ppm) in Europe, setting the detergent composition for clothes and standard usage amount using the European standard washing water of hardness 250 ppm, and appropriately increasing or decreasing the usage amount in accordance with hardness classification and degree of soil in a specific region in which it is used.

At this time, a necessary amount (calculated value) of the organic chelating agent is found for the respective hardnesses (90 ppm and 250 ppm) of the two aforementioned representative regions based on the chelating ability (maximum calcium trapping ability) of the chelating agent to be blended in when setting usage amount of the washing water in typical households to 30 L for fully automatic washing machines, and 15 to 20 L for drum-type washing machines. The necessary amount (calculated value) of the organic chelating agent found in this manner is the least necessary amount of chelating agent according to hardness of the respective regions.

However, as mentioned before, not only hardness components included in the washing water, but those coming out from clothes, those coming out from soil-stained clothes, and those coming out from the washing tub must also be taken into consideration. Then, it may be seen that the actual necessary amount of chelating agent is appropriately designed for the respective chelating agents to be blended therein.

Note that setting the standard usage amount to differ according to type of washing machine is preferred. In other words, it may be seen through the detergency tests that setting the actual necessary amount of chelating agent to a range of minimum usage amount of 105% to 160% in the case of agitation-type washing machines with a large bath ratio (i.e., large amount of washing water in relation to amount of clothing to be washed), and to a range of minimum usage amount of 210% to 320% in the case of drum-type washing machines with a small bath ratio (i.e., small amount of washing water in relation to amount of clothing to be washed) is suitable.

More specifically, in the case of blending chelating agent having chelating ability (maximum calcium trapping ability)

of 200 mg/g, for example, the minimum usage amount of chelating agent in the Japanese standard washing water (hardness: 90 ppm) is found to be 13.5 g/30 L (0.45 g/L) through the following calculating formula.

Hardness of washing water/chelating ability(maximum calcium trapping ability)of chelating agent used×amount of washing water=90/200×30=13.5 g/30 L As settings for the standard usage amount, range from 14.1 to 21.6 g/30 L (0.47 to 0.72 g/L) is preferred for agitation-type washing machines, and range from 19 to 21.6 g/(15 to 20 L) (0.95 to 1.44 g/L) is preferred for drum-type washing machines. With a premise to obtain a detergency equivalent to or greater than that of the standard synthetic detergent, a part of the chelating agent, which is limited to approximately 50% of the aforementioned chelating agent used, may be displaced by an alkaline buffer, particularly crystalline layered sodium silicate.

The usage concentration of the anti-soil redeposition agent in the detergent composition for clothes according to the present invention is 1.5 to 2 g/30 L (0.05 to 0.07 g/L) for agitation-type washing machines, and 3 to 4 g/(15 to 20 L) (0.15 to 0.27 g/L) for drum-type washing machines regardless of the hardness of the washing water.

Accordingly, the total usage concentration including the organic chelating agent, the alkaline buffer, and the anti-soil redeposition agent, which are the essential components of the present invention, is 15.6 to 23.7 g/30 L (0.52 to 0.79 g/L) for agitation-type washing machines, and 22 to 25.7 g/(15 to 20 L) (1.1 to 1.71 g/L) for drum-type washing machines.

On the other hand, in the case of assuming use of the European standard washing water (hardness: 250 ppm), in the case of blending a chelating agent having the chelating ability (maximum calcium trapping ability) of 200 mg/g, for example, the minimum usage amount (concentration) of chelating agent is 1.25 g/L.

When blending amount and usage concentration of chelating agent are found in the same manner as in the example of the Japanese standard washing water, the standard concentration should be preferably set to be within a range between 2.63 and 4.0 g/L for use of drum-type washing machines. With a premise to obtain a detergency equivalent to or greater than that of the standard synthetic detergent, a part of the chelating agent, which is limited to approximately 50% of the aforementioned chelating agent used, may be displaced by an alkaline buffer, particularly crystalline layered sodium silicate.

Since the usage concentration of the anti-soil redeposition agent is 0.15 to 0.27 g/L for drum-type washing machines, the total usage concentration including the organic chelating agent, the alkaline buffer, and the anti-soil redeposition agent, which are the essential components of the present invention, is 2.83 to 4.27 g/L.

Similarly, when a chelating agent having the chelating ability (maximum calcium trapping ability) of 300 mg/g, for example, is blended, the minimum usage amount (concentration) of the chelating agent should be calculated through the same procedure as given above, and based on this calculation result and concept regarding augmentation of chelating agent for each of the respective aforementioned types of washing machines, the blending amount and usage concentration of the chelating agent and usage concentration for respective essential components should be appropriately set.

The range of usage concentration of the detergent composition for clothes according to the present invention is from 0.5 to 10.5 g/L, considering differences in the aforementioned hardness of washing waters.

Note that when adding additives such as washing enzymes, oxy-based bleaching agents, disinfectants, fragrances and foaming agents, for example, in addition to the essential components of the present invention, the usage amount should be increased by an equal amount to that of the additives added.

(6) Additives

The detergent composition of the present invention may further contain substances included as ordinary used components in synthetic detergents, etc., such as washing enzymes, oxy-based bleaching agents, disinfectants, fragrances and foaming agents, in accordance with needs within a range of not departing from the scope of the present invention.

Of the above additives, the washing enzyme is the most important. It is effective in removing soil that is difficult to remove completely with the washing system of the present invention containing an organic chelating agent as a main component for detergency. The washing enzyme may be proteolytic enzyme (protease), lipolytic enzyme (lipase), cellulolytic enzyme (cellulase), amylolytic enzyme (amylase), etc. Among these, protease is particularly effective on daily soil and cellulase is effective for maintaining whiteness of cotton fabrics and removing solid particle soil when repeatedly washed, and are thus are highly useful.

A blending amount of the enzyme should be approximately 0.3% to 3 wt % with respect to the total amount of detergent composition.

Also, since fluidity of the present detergent is alkalescent, ones having an active value not decreasing in their pH ranges must be selected when considering blending of enzymes.

Note that a point to be particularly careful in blending of enzymes in detergents is stability of enzyme activity in washing water, and deactivation due to effective free chlorine included in the washing water has to be particularly noted.

Accordingly, enzymes and reducing agents have to be added at the same time when blending into a detergent. Sulfite and thiosulfate are suitable as a reducing agent, but there is a method of using ammonium sulfate salt and other ammonium salts as a substance to prevent deactivation of enzymes by trapping active chlorine. The blending amount thereof is preferably 0.3% to 3 wt % with respect to the total amount of detergent composition.

An enzymatic bleaching agent may be, for example, sodium percarbonate, sodium perborate, or hydrogen peroxide. The detergent composition of the present invention exhibits equivalent detergency as conventional synthetic detergents including a surfactant as a main ingredient even without use of an enzymatic bleaching agent. However, further improvement of detergency may be expected by adding a bleaching agent. Note that if a bleach activating agent such as ethylenediamine tetracetyl, for example, is used simultaneously when employing oxy-based bleaching agents, further improvement in washing performance may be expected, and is thus preferable.

Disinfectants are blended for the purpose of obtaining an effect of preventing decay and mold of a detergent composition containing organic substances as well as disinfecting clothing to be washed, and may be suitably selected from, for example, benzalkonium chloride, paraben, or propylene glycol, according to intended usage. When considering safeness to the human body, it is preferable to add an extract extracted from seeds of citrus fruits. Here, the citrus fruits are grapefruits having a scientific name of *Citrus Paradisi*, and the extract itself is highly viscous so that it is preferably diluted with water when added, and a dispersing agent, such as natural glycerin or propylene glycol, is preferably used. Since the extract of seeds of *Citrus Paradisi* has an anti-bacterial effect of disinfecting and sanitizing bacteria and microorganisms, an anti-bacterial effect when washing may be expected when added as an anti-bacterial additive to the detergent composition of the present invention. As other disinfectants, a natural disinfectant obtained from, for example, a blend of tea leaves and bamboo may be blended therein.

(7) Production Method of Detergent Composition for Clothes

Since almost all of the raw materials of the detergent composition of the present invention are powder or granular substances and it may be produced just by mixing them uniformly, it may be easily produced in a variety of forms with a variety of methods. The simplest and easiest method is only to agitate and mix the powder raw materials with a well-known batch type mixer, and produce a detergent composition for clothes of the present invention in powder or granular form.

To allow convenient single use doses, a tablet or sheet form may be used. Also, it is also possible to produce the detergent composition of the present invention in a condensed liquid type detergent by mixing the powder material with water.

<Results and Operations of the Present Invention>

According to the present invention, a detergent composition having an organic salt chelating agent as a main component for detergency, without using any surface active agents, use of which has been taken for granted conventionally, that are questionable in terms of safeness on the human body and a reduction in environment burden, and having high washing performance equivalent to or greater than that of synthetic detergents is provided. Also, according to the clothes washing method and detergent composition for clothes of the present invention, it is possible to satisfy two seemingly contradictory demands of consumers in modern countries for extremely high standards, that is, an inclination towards cleanliness that detests uncleanliness and health-consciousness that detests residual detergent components on clothing.

BEST MODE FOR CARRYING OUT THE INVENTION

Below, a specific example of comparing washing performance of a detergent composition or a washing liquid of the present invention with a conventional detergent composition and washing liquid is explained. However, specific values given below are for disclosing as an example a partial detergency obtained by using the detergency composition of the present invention, and not meant to limit the present invention. Note that in working examples and comparative examples related to detergency tests disclosed in the present specification, there are cases where detergency changes in accordance with different lot numbers of stained fabrics to be used, and thus a comparison of detergency between tests using fabrics having respectively different lot numbers should be considered only as a guide.

FIRST DETERGENCY TEST (Test Conditions)

A washing machine, a fully automatic washing machine (NW-7P5 CP, 7 kg capacity, water level set to 30 liters, load of 1.5 kg of towels) manufactured by Hitachi Ltd., was used to carry out an 8 minute wash cycle with 25 degree Celsius tap water (Fujisawa city municipal tap water, pH of 7.5, total hardness of 60 ppm), two rinse cycles, and a 5 minute spin cycle.

Wet-type artificially stained fabric samples (manufactured by the Laundry Research Association) stained with synthetic sebum were used. For the purpose of taking the average of differences in detergency ratio occurring between different lot numbers, two stained fabric samples differing in lot number were prepared, and five swatches (ten swatches for convenience) of each of these stained fabric samples were sewn onto towels and washed. In addition to these wet-type artificially stained fabric samples, a part of the tests used fabric stained with mineral oil and carbon black (EMPA101), fabric stained with olive oil and carbon black (EMPA106), fabric stained with blood (EMPA111), fabric stained with protein (EMPA112), fabric stained with red wine (EMPA114) and fabric stained with blood, milk and carbon black (EMPA116). At this time, three swatches (eight swatches for convenience) of the EMPA stained fabrics were sewn onto towels and washed.

(Calculation of Detergency Ratio)

Detergency ratio is calculated from the following formula:

Detergency ratio(%)=(whiteness index of stained fabric after washing−whiteness index of stained fabric before washing)/(whiteness index of unstained fabric−whiteness index of stained fabric before washing)×100

Whiteness index is found by measuring ten points on both sides of the respective stained fabrics using a whiteness tester (manufactured by Minolta Co., Ltd., CR-14, Whiteness Index Color Reader), and then averaging these measured values.

(pH of Washing Liquid)

pH of washing liquid obtained by adding a detergent composition to a washing water was measured at 25 degrees Celsius using a glass electrode pH meter (manufactured by Horiba Ltd.). The resulting value was sufficiently stable and thus considered to be the pH of the washing liquid.

Note that the detergency tests disclosed in the present specification are conducted in following test conditions unless specifically mentioned.

WORKING EXAMPLE 1

A washing liquid having a detergent concentration of 0.55 g/L and a pH of 10.0 was obtained by dissolving a total component amount of detergent of 16.5 g in 30 liters of tap water where the detergent has a component composition including 10.5 g trisodium methylglycinediacetic acid, 2.9 g crystalline layered sodium silicate, 1.6 g sodium hydrogen carbonate, 1.3 g polyvinyl alcohol (abbreviated as 'PVA' hereafter), and 0.2 g carboxy methyl cellulose (abbreviated as 'CMC' hereafter). The detergency ratio of the respective wet-type artificially stained fabrics was measured before and after washing with the washing liquid. The results are shown in Table 3.

WORKING EXAMPLE 2

A washing liquid having a detergent concentration of 0.55 g/L and a pH of 10.0 was obtained by dissolving a total component amount of detergent of 16.5 g in 30 liters of tap water where the detergent has a component composition including 12 g trisodium methylglycinediacetic acid, 2 g crystalline layered sodium silicate, 1 g sodium hydrogen carbonate, 1.3 g PVA, and 0.2 g CMC. The detergency ratio of the respective wet-type artificially stained fabrics was measured before and after washing with the washing liquid. The results are shown in Table 3.

WORKING EXAMPLE 3

A washing liquid having a detergent concentration of 0.55 g/L and a pH of 10.0 was obtained by dissolving a total component amount of detergent of 16.5 g in 30 liters of tap water where the detergent has a component composition including 15 g trisodium methylglycinediacetic acid, 1.3 g PVA, and 0.2 g CMC. The detergency ratio of the respective wet-type artificially stained fabrics was measured before and after washing with the washing liquid. The results are shown in Table 3.

WORKING EXAMPLE 4

A washing liquid having a detergent concentration of 0.72 g/L and a pH of 10.3 was obtained by dissolving a total component amount of detergent of 21.5 g in 30 liters of tap water where the detergent has a component composition including 8 g trisodium methylglycinediacetic acid, 7.8 g crystalline layered sodium silicate, 4.2 g sodium hydrogen carbonate, 1.3 g PVA, and 0.2 g CMC. The detergency ratio of the respective wet-type artificially stained fabrics was measured before and after washing with the washing liquid. The results are shown in Table 3.

WORKING EXAMPLE 5

A washing liquid having a detergent concentration of 0.72 g/L and a pH of 10.3 was obtained by dissolving a total component amount of detergent of 21.5 g in 30 liters of tap water where the detergent has a component composition including 10 g trisodium methylglycinediacetic acid, 6.5 g crystalline layered sodium silicate, 3.5 g sodium hydrogen carbonate, 1.3 g PVA, and 0.2 g CMC. The detergency ratio of the respective wet-type artificially stained fabrics was measured before and after washing with the washing liquid. The results are shown in Table 3.

WORKING EXAMPLE 6

A washing liquid having a detergent concentration of 0.72 g/L and a pH of 10.3 was obtained by dissolving a total component amount of detergent of 21.5 g in 30 liters of tap water where the detergent has a component composition including 12 g trisodium methylglycinediacetic acid, 5.2 g crystalline layered sodium silicate, 2.8 g sodium hydrogen carbonate, 1.3 g PVA, and 0.2 g CMC. The detergency ratio of the respective wet-type artificially stained fabrics was measured before and after washing with the washing liquid. The results are shown in Table 3.

WORKING EXAMPLE 7

A washing liquid having a detergent concentration of 0.72 g/L and a pH of 10.3 was obtained by dissolving a total component amount of detergent of 21.5 g in 30 liters of tap water where the detergent has a component composition including 16 g trisodium methylglycinediacetic acid, 2.6 g crystalline layered sodium silicate, 1.4 g sodium hydrogen carbonate, 1.3 g PVA, and 0.2 g CMC. The detergency ratio of the respective wet-type artificially stained fabrics was measured before and after washing with the washing liquid. The results are shown in Table 3.

WORKING EXAMPLE 8

A washing liquid having a detergent concentration of 0.72 g/L and a pH of 10.3 was obtained by dissolving a total component amount of detergent of 21.5 g in 30 liters of tap water where the detergent has a component composition including 20 g trisodium methylglycinediacetic acid, 1.3 g PVA, and 0.2 g CMC. The detergency ratio of the respective wet-type artificially stained fabrics was measured before and after washing with the washing liquid. The results are shown in Table 3.

WORKING EXAMPLE 9

A washing liquid having a detergent concentration of 0.88 g/L and a pH of 10.5 was obtained by dissolving a total component amount of detergent of 26.5 g in 30 liters of tap water where the detergent has a component composition including 7.5 g trisodium methylglycinediacetic acid, 12.3 g crystalline layered sodium silicate, 5.2 g sodium hydrogen carbonate, 1.3 g PVA, and 0.2 g CMC. The detergency ratio of the respective wet-type artificially stained fabrics was measured before and after washing with the washing liquid. The results are shown in Table 3.

WORKING EXAMPLE 10

A washing liquid having a detergent concentration of 0.88 g/L and a pH of 10.5 was obtained by dissolving a total component amount of detergent of 26.5 g in 30 liters of tap water where the detergent has a component composition including 10 g trisodium methylglycinediacetic acid, 10.6 g crystalline layered sodium silicate, 4.4 g sodium hydrogen carbonate, 1.3 g PVA, and 0.2 g CMC. The detergency ratio of the respective wet-type artificially stained fabrics was measured before and after washing with the washing liquid. The results are shown in Table 3.

WORKING EXAMPLE 11

A washing liquid having a detergent concentration of 0.88 g/L and a pH of 10.5 was obtained by dissolving a total component amount of detergent of 26.5 g in 30 liters of tap water where the detergent has a component composition including 15 g trisodium methylglycinediacetic acid, 7.2 g crystalline layered sodium silicate, 2.8 g sodium hydrogen carbonate, 1.3 g PVA, and 0.2 g CMC. The detergency ratio of the respective wet-type artificially stained fabrics was measured before and after washing with the washing liquid. The results are shown in Table 3.

WORKING EXAMPLE 12

A washing liquid having a detergent concentration of 0.88 g/L and a pH of 10.5 was obtained by dissolving a total component amount of detergent of 26.5 g in 30 liters of tap water where the detergent has a component composition including 20 g trisodium methylglycinediacetic acid, 3.8 g crystalline layered sodium silicate, 1.2 g sodium hydrogen carbonate, 1.3 g PVA, and 0.2 g CMC. The detergency ratio of the respective wet-type artificially stained fabrics was measured before and after washing with the washing liquid. The results are shown in Table 3.

WORKING EXAMPLE 13

A washing liquid having a detergent concentration of 0.88 g/L and a pH of 10.5 was obtained by dissolving a total component amount of detergent of 26.5 g in 30 liters of tap water where the detergent has a component composition including 25 g trisodium methylglycinediacetic acid, 1.3 g PVA, and 0.2 g CMC. The detergency ratio of the respective wet-type artificially stained fabrics was measured before and after washing with the washing liquid. The results are shown in Table 3.

[Table 3]

TABLE 3

| | TOTAL AMOUNT/ CONCENTRATION OF DETERGENT (TOP: g/BOTTOM: gL) | DETERGENT COMPOSITION (TOP: BLENDING AMOUNT(g)/BOTTOM: BLENDING RATIO (WT %)) | | | | |
|---|---|---|---|---|---|---|
| | | CHELATING AGENT | ALKALINE BUFFER | | | |
| | | TRISODIUM METHYLGLYCINE-DIAC | CRYSTALLINE LAYERED SODIUM SILICATE | SODIUM HYDROGEN CARBONATE | ANTI-SOIL REDEPOSITION PVA | ANTI-SOIL REDEPOSITION CMC |
| WORKING EXAMPLE 1 | 16.5 | 10.5 | 2.9 | 1.6 | 1.3 | 0.2 |
| | 0.55 | 63.6 | 17.6 | 9.7 | 7.9 | 1.2 |
| WORKING EXAMPLE 2 | 16.5 | 12.0 | 2 | 1.0 | 1.3 | 0.2 |
| | 0.55 | 72.7 | 12.1 | 6.1 | 7.9 | 1.2 |
| WORKING EXAMPLE 3 | 16.5 | 15.0 | 0 | 0 | 1.3 | 0.2 |
| | 0.55 | 90.9 | 0 | 0 | 7.9 | 1.2 |
| WORKING EXAMPLE 4 | 21.5 | 8.0 | 7.8 | 4.2 | 1.3 | 0.2 |
| | 0.72 | 37.2 | 36.3 | 19.5 | 6.0 | 0.9 |
| WORKING EXAMPLE 5 | 21.5 | 10.0 | 6.5 | 3.5 | 1.3 | 0.2 |
| | 0.72 | 46.5 | 30.2 | 16.3 | 6.0 | 0.9 |
| WORKING EXAMPLE 6 | 21.5 | 12.0 | 5.2 | 2.8 | 1.3 | 0.2 |
| | 0.72 | 55.8 | 24.2 | 13.0 | 6.0 | 0.9 |
| WORKING EXAMPLE 7 | 21.5 | 16.0 | 2.6 | 1.4 | 1.3 | 0.2 |
| | 0.72 | 74.4 | 12.1 | 6.5 | 6.0 | 0.9 |
| WORKING EXAMPLE 8 | 21.5 | 20.0 | 0 | 0 | 1.3 | 0.2 |
| | 0.72 | 93.0 | 0 | 0 | 6.0 | 0.9 |
| WORKING EXAMPLE 9 | 26.5 | 7.5 | 12.3 | 5.2 | 1.3 | 0.2 |
| | 0.88 | 28.3 | 46.4 | 19.6 | 4.9 | 0.8 |
| WORKING EXAMPLE 10 | 26.5 | 10.0 | 10.6 | 4.4 | 1.3 | 0.2 |
| | 0.88 | 37.7 | 40 | 16.6 | 4.9 | 0.8 |
| WORKING EXAMPLE 11 | 26.5 | 15.0 | 7.2 | 2.8 | 1.3 | 0.2 |
| | 0.88 | 56.6 | 27.2 | 10.6 | 4.9 | 0.8 |
| WORKING EXAMPLE 12 | 26.5 | 20.0 | 3.8 | 1.2 | 1.3 | 0.2 |
| | 0.88 | 75.5 | 14.3 | 4.5 | 4.9 | 0.8 |
| WORKING EXAMPLE 13 | 26.5 | 25.0 | 0 | 0 | 1.3 | 0.2 |
| | 0.88 | 94.3 | 0 | 0 | 4.9 | 0.8 |

| | DETERGENT COMPOSITION (TOP: BLENDING AMOUNT(g)/BOTTOM: BLENDING RATIO (WT %)) | | | | WASHING RATIO (%) |
|---|---|---|---|---|---|
| | ENZYME | | | | ARTIFICIALLY |
| | PROTEASE | SODIUM SULFITE | OTHER | pH | STAINED FABRIC |
| WORKING EXAMPLE 1 | 0 | 0 | 0 | 10 | 48.9 |
| | 0 | 0 | 0 | | |
| WORKING EXAMPLE 2 | 0 | 0 | 0 | 10 | 52.5 |
| | 0 | 0 | 0 | | |
| WORKING EXAMPLE 3 | 0 | 0 | 0 | 10 | 52.5 |
| | 0 | 0 | 0 | | |
| WORKING EXAMPLE 4 | 0 | 0 | 0 | 10.3 | 51.4 |
| | 0 | 0 | 0 | | |
| WORKING EXAMPLE 5 | 0 | 0 | 0 | 10.3 | 53.6 |
| | 0 | 0 | 0 | | |
| WORKING EXAMPLE 6 | 0 | 0 | 0 | 10.3 | 56.6 |
| | 0 | 0 | 0 | | |
| WORKING EXAMPLE 7 | 0 | 0 | 0 | 10.3 | 55.8 |
| | 0 | 0 | 0 | | |
| WORKING EXAMPLE 8 | 0 | 0 | 0 | 10.3 | 56.2 |
| | 0 | 0 | 0 | | |
| WORKING EXAMPLE 9 | 0 | 0 | 0 | 10.5 | 49.5 |
| | 0 | 0 | 0 | | |
| WORKING EXAMPLE 10 | 0 | 0 | 0 | 10.5 | 54.6 |
| | 0 | 0 | 0 | | |
| WORKING EXAMPLE 11 | 0 | 0 | 0 | 10.5 | 56 |
| | 0 | 0 | 0 | | |
| WORKING EXAMPLE 12 | 0 | 0 | 0 | 10.5 | 55.3 |
| | 0 | 0 | 0 | | |
| WORKING EXAMPLE 13 | 0 | 0 | 0 | 10.5 | 56.5 |
| | 0 | 0 | 0 | | |

WORKING EXAMPLE 14

A washing liquid having a detergent concentration of 1.05 g/L and a pH of 10.6 was obtained by dissolving a total component amount of detergent of 31.5 g in 30 liters of tap water where the detergent has a component composition including 3 g trisodium methylglycinediacetic acid, 19 g crystalline layered sodium silicate, 8 g sodium hydrogen carbonate, 1.3 g PVA, and 0.2 g CMC. The detergency ratio of the respective wet-type artificially stained fabrics was measured before and after washing with the washing liquid. The results are shown in Table 4.

WORKING EXAMPLE 15

A washing liquid having a detergent concentration of 1.05 g/L and a pH of 10.6 was obtained by dissolving a total component amount of detergent of 31.5 g in 30 liters of tap water where the detergent has a component composition including 6 g trisodium methylglycinediacetic acid, 17 g crystalline layered sodium silicate, 7 g sodium hydrogen carbonate, 1.3 g PVA, and 0.2 g CMC. The detergency ratio of the respective wet-type artificially stained fabrics was measured before and after washing with the washing liquid. The results are shown in Table 4.

WORKING EXAMPLE 16

A washing liquid having a detergent concentration of 1.05 g/L and a pH of 10.6 was obtained by dissolving a total component amount of detergent of 31.5 g in 30 liters of tap water where the detergent has a component composition including 12 g trisodium methylglycinediacetic acid, 13 g crystalline layered sodium silicate, 5 g sodium hydrogen carbonate, 1.3 g PVA, and 0.2 g CMC. The detergency ratio of the respective wet-type artificially stained fabrics was measured before and after washing with the washing liquid. The results are shown in Table 4.

WORKING EXAMPLE 17

A washing liquid having a detergent concentration of 1.05 g/L and a pH of 10.6 was obtained by dissolving a total component amount of detergent of 31.5 g in 30 liters of tap water where the detergent has a component composition including 18 g trisodium methylglycinediacetic acid, 8.8 g crystalline layered sodium silicate, 3.2 g sodium hydrogen carbonate, 1.3 g PVA, and 0.2 g CMC. The detergency ratio of the respective wet-type artificially stained fabrics was measured before and after washing with the washing liquid. The results are shown in Table 4.

WORKING EXAMPLE 18

A washing liquid having a detergent concentration of 1.05 g/L and a pH of 10.6 was obtained by dissolving a total component amount of detergent of 31.5 g in 30 liters of tap water where the detergent has a component composition including 24 g trisodium methylglycinediacetic acid, 4.4 g crystalline layered sodium silicate, 1.6 g sodium hydrogen carbonate, 1.3 g PVA, and 0.2 g CMC. The detergency ratio of the respective wet-type artificially stained fabrics was measured before and after washing with the washing liquid. The results are shown in Table 4.

WORKING EXAMPLE 19

A washing liquid having a detergent concentration of 1.05 g/L and a pH of 10.6 was obtained by dissolving a total component amount of detergent of 31.5 g in 30 liters of tap water where the detergent has a component composition including 30 g trisodium methylglycinediacetic acid, 1.3 g PVA, and 0.2 g CMC. The detergency ratio of the respective wet-type artificially stained fabrics was measured before and after washing with the washing liquid. The results are shown in Table 4.

WORKING EXAMPLE 20

A washing liquid having a detergent concentration of 0.67 g/L and a pH of 10.5 was obtained by dissolving a total component amount of detergent of 20 g in 30 liters of tap water where the detergent has a component composition including 10 g trisodium methylglycinediacetic acid, 7.2 g crystalline layered sodium silicate, 0.8 g sodium hydrogen carbonate, 1.3 g PVA, 0.2 g CMC, 0.2 g protease, and 0.3 g sodium sulfite. The detergency ratio of the respective wet-type artificially stained fabrics and the respective EMPA stained fabrics was measured before and after washing with the washing liquid. The results are shown in Tables 4 and 5.

COMPARATIVE EXAMPLE 1

As a comparative example of Working Examples 1 to 20, a washing liquid having a detergent concentration of 0.55 g/L and a pH of 10.0 was obtained by dissolving a total component amount of detergent of 16.5 g in 30 liters of tap water where the detergent has a component composition including 9.2 g crystalline layered sodium silicate, 5.8 g sodium hydrogen carbonate, 1.3 g PVA, and 0.2 g CMC. The detergency ratio of the respective wet-type artificially stained fabrics was measured before and after washing with the washing liquid. The results are shown in Table 4.

COMPARATIVE EXAMPLE 2

As a comparative example of Working Examples 1 to 20, a washing liquid having a detergent concentration of 0.72 g/L and a pH of 10.3 was obtained by dissolving a total component amount of detergent of 21.5 g in 30 liters of tap water where the detergent has a component composition including 12.8 g crystalline layered sodium silicate, 7.2 g sodium hydrogen carbonate, 1.3 g PVA, and 0.2 g CMC. The detergency ratio of the respective wet-type artificially stained fabrics was measured before and after washing with the washing liquid. The results are shown in Table 4.

COMPARATIVE EXAMPLE 3

As a comparative example of Working Examples 1 to 20, a washing liquid having a detergent concentration of 0.88 g/L and a pH of 10.5 was obtained by dissolving a total component amount of detergent of 26.5 g in 30 liters of tap water where the detergent has a component composition including 17 g crystalline layered sodium silicate, 8 g sodium hydrogen carbonate, 1.3 g PVA, and 0.2 g CMC. The detergency ratio of the respective wet-type artificially stained fabrics was measured before and after washing with the washing liquid. The results are shown in Table 4.

COMPARATIVE EXAMPLE 4

As a comparative example of Working Examples 1 to 20, a washing liquid having a detergent concentration of 1.05 g/L and a pH of 10.6 was obtained by dissolving a total component amount of detergent of 31.5 g in 30 liters of tap water where the detergent has a component composition including 21.2 g crystalline layered sodium silicate, 8.8 g sodium hydrogen carbonate, 1.3 g PVA, and 0.2 g CMC. The detergency ratio of the respective wet-type artificially stained fabrics was measured before and after washing with the washing liquid. The results are shown in Table 4.

COMPARATIVE EXAMPLE 5

As a comparative example of Working Examples 1 to 20, the detergency ratio of the respective wet-type artificially stained fabrics and the respective EMPA stained fabrics was measured before and after washing with merely 30 liters of tap water. The results are shown in Tables 4 and 5.

COMPARATIVE EXAMPLE 6

Use of a mixture of linear sodium alkylbenzene sulfonate, sodium silicate, sodium carbonate, sodium carboxy methyl cellulose, and sodium sulfite in a ratio of 15:5:7:1:55 in order as an indicator detergent for detergency determination (referred to as Japanese standard detergent in the present specification) is stipulated in the synthetic detergent test method (standard number JIS K 3362:1998) standardized by the Japanese Standards Association.

As a comparative example of Working Examples 1 to 20, the detergency ratio of the respective wet-type artificially stained fabrics and the respective EMPA stained fabrics was measured before and after washing with a washing liquid obtained by dissolving the aforementioned Japanese standard detergent in 30 liters of tap water at a standard concentration (detergent concentration of 1.33 g/L). The results are shown in Tables 4 and 5.

COMPARATIVE EXAMPLE 7

As a comparative example of Working Examples 1 to 20, the detergency ratio of the respective wet-type artificially stained fabrics and the respective EMPA stained fabrics was measured before and after washing with a washing liquid obtained by dissolving a commercially available powdered synthetic detergent (Attack Bio Enzymes, detergent concentration 0.67 g/L, manufactured by Kao Corporation, enzymes and fluorescent brightening agent included) in 30 liters of tap water at a standard concentration. The results are shown in Tables 4 and 5.

[Table 4]

TABLE 4

| | | DETERGENT COMPOSITION (TOP: BLENDING AMOUNT (g)/BOTTOM: BLENDING RATIO (WT %)) | | | | |
|---|---|---|---|---|---|---|
| | | CHELATING AGENT | ALKALINE BUFFER | | ANTI-SOIL REDEPOSITION AGENT | |
| | TOTAL AMOUNT/ CONCENTRATION OF DETERGENT | TRISODIUM METHYL-GLYCINEDIACETIC ACID | CRYSTALLINE LAYERED SODIUM SILICATE | SODIUM HYDROGEN CARBONATE | PVA | CMC |
| WORKING | 31.5 | 3.0 | 19.0 | 8.0 | 1.3 | 0.2 |
| EXAMPLE 14 | 1.05 | 9.5 | 60.3 | 25.4 | 4.1 | 0.6 |
| WORKING | 31.5 | 6.0 | 17.0 | 7.0 | 1.3 | 0.2 |
| EXAMPLE 15 | 1.05 | 19.0 | 54.0 | 22.2 | 4.1 | 0.6 |
| WORKING | 31.5 | 12.0 | 13.0 | 5.0 | 1.3 | 0.2 |
| EXAMPLE 16 | 1.05 | 38.1 | 41.3 | 15.9 | 4.1 | 0.6 |
| WORKING | 31.5 | 18.0 | 8.8 | 3.2 | 1.3 | 0.2 |
| EXAMPLE 17 | 1.05 | 57.1 | 27.9 | 10.2 | 4.1 | 0.6 |
| WORKING | 31.5 | 24.0 | 4.4 | 1.6 | 1.3 | 0.2 |
| EXAMPLE 18 | 1.05 | 76.2 | 14.0 | 5.1 | 4.1 | 0.6 |
| WORKING | 31.5 | 30.0 | 0 | 0 | 1.3 | 0.2 |
| EXAMPLE 19 | 1.05 | 95.2 | 0 | 0 | 4.1 | 0.6 |
| WORKING | 20.0 | 10.0 | 7.2 | 0.8 | 1.3 | 0.2 |
| EXAMPLE 20 | 0.67 | 50.0 | 36.0 | 4.0 | 6.5 | 1.0 |
| COMPARATIVE | 16.5 | 0 | 9.2 | 5.8 | 1.3 | 0.2 |
| EXAMPLE 1 | 0.55 | 0 | 55.8 | 35.1 | 7.9 | 1.2 |
| COMPARATIVE | 21.5 | 0 | 12.8 | 7.2 | 1.3 | 0.2 |
| EXAMPLE 2 | 0.72 | 0 | 59.5 | 33.5 | 6.1 | 0.9 |
| COMPARATIVE | 26.5 | 0 | 17.0 | 8.0 | 1.3 | 0.2 |
| EXAMPLE 3 | 0.88 | 0 | 64.1 | 30.2 | 4.9 | 0.8 |
| COMPARATIVE | 31.5 | 0 | 21.2 | 8.8 | 1.3 | 0.2 |
| EXAMPLE 4 | 1.05 | 0 | 67.3 | 28.0 | 4.1 | 0.6 |
| COMPARATIVE EXAMPLE 5 | | TAP WATER | | | | |
| COMPARATIVE | 40 | JAPANESE STANDARD DETERGENT | | | | |
| EXAMPLE 6 | 1.33 | | | | | |
| COMPARATIVE | 20 | COMMERCIALLY AVAILABLE POWDERED SYNTHETIC DETERGENT (ATTACK BIO ENZYMES) | | | | |
| EXAMPLE 7 | 0.67 | | | | | |

| | DETERGENT COMPOSITION (TOP: BLENDING AMOUNT (g)/BOTTOM: BLENDING RATIO (WT %)) | | | | DETERGENCY (%) |
|---|---|---|---|---|---|
| | ENZYME | | | | ARTIFICIALLY |
| | PROTEASE | SODIUM SULFITE | OTHER | pH | STAINED FABRIC |
| WORKING | 0 | 0 | 0 | 10.6 | 49.1 |
| EXAMPLE 14 | 0 | 0 | 0 | | |

TABLE 4-continued

| | | | | | |
|---|---|---|---|---|---|
| WORKING | 0 | 0 | 0 | 10.6 | 51.3 |
| EXAMPLE 15 | 0 | 0 | 0 | | |
| WORKING | 0 | 0 | 0 | 10.6 | 57.1 |
| EXAMPLE 16 | 0 | 0 | 0 | | |
| WORKING | 0 | 0 | 0 | 10.6 | 57.1 |
| EXAMPLE 17 | 0 | 0 | 0 | | |
| WORKING | 0 | 0 | 0 | 10.6 | 56.1 |
| EXAMPLE 18 | 0 | 0 | 0 | | |
| WORKING | 0 | 0 | 0 | 10.6 | 56.5 |
| EXAMPLE 19 | 0 | 0 | 0 | | |
| WORKING | 0.2 | 0.3 | 0 | 10.5 | 65.2 |
| EXAMPLE 20 | 1.0 | 1.5 | 0 | | |
| COMPARATIVE | 0 | 0 | 0 | 10.0 | 28.9 |
| EXAMPLE 1 | 0 | 0 | 0 | | |
| COMPARATIVE | 0 | 0 | 0 | 10.3 | 36.5 |
| EXAMPLE 2 | 0 | 0 | 0 | | |
| COMPARATIVE | 0 | 0 | 0 | 10.5 | 39.5 |
| EXAMPLE 3 | 0 | 0 | 0 | | |
| COMPARATIVE | 0 | 0 | 0 | 10.6 | 47.1 |
| EXAMPLE 4 | 0 | 0 | 0 | | |
| COMPARATIVE EXAMPLE 5 | 0 | 0 | 0 | 7.5 | 22.8 |
| COMPARATIVE EXAMPLE 6 | 0 | 0 | 0 | 10.0 | 40.4 |
| COMPARATIVE EXAMPLE 7 | | ○ | FLUORESCENT BRIGHTENING AGENT | 10.0 | 49.8 |

[Table 5]

TABLE 5

| | | | DETERGENCY (%) | | | | | | |
|---|---|---|---|---|---|---|---|---|---|
| | | | ARTIFICIALLY | EMPA STAINED FABRIC | | | | | |
| | TYPE | pH | STAINED FABRIC | 101 | 105 | 111 | 112 | 114 | 116 |
| WORKING EXAMPLE 20 | PREFERRED EMBODIMENT | 10.5 | 65.2 | 24.0 | 33.1 | 85.1 | 46.4 | 54.8 | 51.7 |
| COMPARATIVE EXAMPLE 5 | TAP WATER | 7.5 | 22.8 | 11.5 | 12.0 | 32.4 | 18.5 | 36.1 | 8.5 |
| COMPARATIVE EXAMPLE 6 | JAPANESE STANDARD DETERGENT | 10.0 | 40.4 | 21.6 | 23.9 | 81.5 | 24.6 | 27.6 | 29.5 |
| COMPARATIVE EXAMPLE 7 | COMMERCIALLY AVAILABLE POWDERED SYNTHETIC DETERGENT | 10.0 | 49.8 | 23.6 | 25.9 | 75.7 | 30.5 | 39.5 | 48.4 |

(First Detergency Test: Detergency Test Results and Review Thereof)

When comparing the detergency ratios of Working Examples 1 to 20 with those of Comparative Examples 6 and 7, the washing liquids having the organic chelating agent according to the present invention as a main component for detergency show detergency ratios almost equivalent to or greater than the commercially available synthetic detergent having a surfactant as a main component for detergency.

Of these, Working Example 20 is compared with Comparative Examples 6 and 7 while referring to Table 3. As it can be seen from this comparison, that of Working Example 20 to which enzymes and a reducing agent were further added shows a washing performance exceeding that of the conventional synthetic detergent for all types of soil such as synthetic sebum (artificially stained fabric), a mixture of mineral oil and carbon black (EMPA101), a mixture of olive oil and carbon black (EMPA106), blood (EMPA111), protein (EMPA112), red wine (EMPA114) and a mixture of blood, milk and carbon black (EMPA116), exhibiting an all-mighty detergency. Furthermore, as it can be seen from comparing Working Example 20 with Comparison Examples 6 and 7 in terms of detergent concentration, the detergent concentration is 0.67 g/L in Working Example 20, 1.33 g/L in Comparative Example 6, and 0.67 g/L in Comparative Example 7. Even looking at usage amount of detergent, the usage amount in Working Example 20 was only approximately half of that of the Japanese standard detergent in Comparative Example 6, and an equivalent amount to the commercially available powdered synthetic detergent in Comparative Example 7.

Next, grounds for the washing liquids according to the working examples being those having an organic chelating agent as a main component for detergency are mentioned. Note that 'main component for detergency' is defined herein as one of components of a detergent composition contributing mainly to improvement in detergency (detergency ratio). Furthermore, 'contributing mainly to improvement in detergency (detergency ratio)' is a concept including both a case where detergency (detergency ratio) is improved by a small blend, and a case where detergency (detergency ratio) is raised to a high standard by blending it therein (for example, equivalent to or greater than the detergency ratio of Comparative Example 7).

In order to clarify that the washing liquids according to the working examples of the present invention are clearly those having an organic chelating agent as a main component for detergency, three types of washing liquids differing in composition from each other and having equivalent washing conditions such as detergent usage amount and concentration, and pH were compared to each other.

To begin with, three washing liquids having the same conditions of a detergent usage amount of 16.5 g (detergent concentration: 0.55 g/L) and a pH of 10.0 were obtained by dissolving in 30 liters of tap water 15 g alkaline buffer for Comparative Example 1, 15 g organic chelating agent for Working Example 3, and 10.5 g organic chelating agent and 4.5 g alkaline buffer for Working Example 1, in addition to respectively common 1.5 g anti-soil redeposition agent. Here, comparing Working Examples 1 and 3 with Comparative Example 1, high detergency ratios of 52.2% for the organic chelating agent alone (Working Example 3) and 48.96 for the combination of organic chelating agent and alkaline buffer (Working Example 1) were obtained while detergency ratio for alkaline buffer alone (Comparative Example 1) was 28.9%, being outshone considerably. In this case, since the organic chelating agent clearly contributes mainly to improvement in detergency (detergency ratio), it can be said that the washing liquids according to Working Examples 1 and 3 are those having an organic chelating agent as a main component for detergency.

Similarly, three washing liquids having the same conditions of a detergent usage amount of 21.5 g (detergent concentration: 0.72 g/L) and a pH of 10.3 were obtained by dissolving in 30 liters of tap water 20 g alkaline buffer for Comparative Example 2, 20 g organic chelating agent for Working Example 8, and 10 g organic chelating agent and 10 g alkaline buffer for Working Example 5, in addition to respectively common 1.5 g anti-soil redeposition agent. Here, comparing Working Examples 5 and 8 with Comparative Example 2, high detergency ratios of 56.2% for the organic chelating agent alone (Working Example 8) and 53.6% for the combination of organic chelating agent and alkaline buffer (Working Example 5) were obtained while detergency ratio for alkaline buffer alone (Comparative Example 2) was 36.5%, comparing unfavorably. In this case, since the organic chelating agent clearly contributes mainly to improvement in detergency (detergency ratio), it can be said that the washing liquids according to Working Examples 5 and 8 are those having an organic chelating agent as a main component for detergency.

Similarly, three washing liquids having the same conditions of a detergent usage amount of 26.5 g (detergent concentration: 0.88 g/L) and a pH of 10.5 were obtained by dissolving in 30 liters of tap water 25 g alkaline buffer for Comparative Example 3, 25 g organic chelating agent for Working Example 13, and 10 g organic chelating agent and 15 g alkaline buffer for Working Example 10, in addition to respectively common 1.5 g anti-soil redeposition agent. Here, comparing Working Examples 10 and 13 with Comparative Example 3, high detergency ratios of 56.5% for the organic chelating agent alone (Working Example 13) and 54.6% for the combination of organic chelating agent and alkaline buffer (Working Example 10) were obtained while detergency ratio for alkaline buffer alone (Comparative Example 3) was 39.5%, comparing unfavorably. In this case, since the organic chelating agent clearly contributes mainly to improvement in detergency (detergency ratio), it can be said that the washing liquids according to Working Examples 10 and 13 are those having an organic chelating agent as a main component for detergency.

Similarly, three washing liquids having the same conditions of a detergent usage amount of 31.5 g (detergent concentration: 1.05 g/L) and a pH of 10.6 were obtained by dissolving in 30 liters of tap water 30 g alkaline buffer for Comparative Example 4, 30 g organic chelating agent for Working Example 19, and 12 g organic chelating agent and 18 g alkaline buffer for Working Example 16, in addition to respectively common 1.5 g anti-soil redeposition agent. Here, comparing Working Examples 16 and 19 with Comparative Example 4, high detergency ratios of 56.5% for the organic chelating agent alone (Working Example 19) and 57.1% for the combination of organic chelating agent and alkaline buffer (Working Example 16) were obtained while detergency ratio for alkaline buffer alone (Comparative Example 4) was 47.1%, which is slightly less. In this case, since the organic chelating agent clearly contributes mainly to improvement in detergency (detergency ratio), it can be said that the washing liquids according to Working Examples 16 and 19 are those having an organic chelating agent as a main component for detergency.

Even in examples other than the aforementioned Working Examples 1, 3, 5, 8, 10, 13, 16, and 19, blend of the organic chelating agent allows improvement in detergency (detergency ratio) or raising detergency (detergency ratio) to a high standard.

As a result, it can be said that the washing liquids according to Working Examples 1 to 20 are those having an organic chelating agent as a main component for detergency.

(First Detergency Test: Summary)

In Working Examples 1 to 20 of the first detergency test, trisodium methylglycinediacetic acid (MGDA-3Na, maximum calcium trapping ability is 327 mg/g for pH 11) was used as the organic chelating agent. The calculated necessary amount of MGDA-3Na to completely destroy the hardness components included in the washing water (60 mg/L hardness components included, washing water amount: 30 liters) used in this test is found using the following expression.

$$60/327\times30\approx5.5\text{ g}$$

As it can be seen from referring to Tables 3 and 4 for Working Examples 1 to 20, the usage amount of MGDA-3Na falls below 5.5 g only in Working Example 14, and the range of usage amount of MGDA-3Na is 6 to 30 g if Working Example 14 is excluded. In any of the examples, an amount of organic chelating agent (MGDA-3Na) exceeding the calculated necessary amount was used.

Note that in Working Example 14, while the usage amount of MGDA-3Na is 3 g (blending ratio within the total amount of detergent is 9.5%), falling below the calculated necessary amount (5.5 g), usage amount of crystalline layered sodium silicate is 19 g (blending ratio within the total amount of detergent is 60.3%), which is a large amount. Such a large amount of crystalline layered sodium silicate may be considered to maintain a high detergency equivalent to that of the commercially available synthetic detergent by supplementing the hardness component trapping ability of the organic chelating agent (MGDA-3Na).

Next, preferred working examples of detergent compositions targeted to the Japanese market are disclosed in a second detergency test while comparing to comparative examples.

Second Detergency Test

Test conditions are almost the same as those for the above-given first detergency test. To mention the differences for the second detergency test, a tergotometer was used to carry out a 10 minute wash cycle at a rotation speed of 120 rpm with 1 liter of 30 degrees Celsius washing water (Japanese standard washing water) using substances and detergent concentrations given in the following working examples and comparative examples, and two rinse cycles.

WORKING EXAMPLE 21

A washing liquid having a detergent concentration of 0.57 g/L and a pH of 10.5 was obtained by dissolving a total component amount of detergent of 17 g in 30 liters of the Japanese standard washing water where the detergent has a component composition including 10 g trisodium methylglycinediacetic acid, 3.5 g crystalline layered sodium silicate, 1.5 g sodium hydrogen carbonate, 1.3 g PVA, 0.2 g CMC, 0.2 g protease, and 0.3 g sodium sulfite. The detergency ratio of the respective wet-type artificially stained fabrics and the respective EMPA stained fabrics was measured before and after washing with this washing liquid. The results are shown in Tables 6 and 7.

WORKING EXAMPLE 22

A washing liquid having a detergent concentration of 0.57 g/L and a pH of 10.5 was obtained by dissolving a total component amount of detergent of 17 g in 30 liters of the Japanese standard washing water where the detergent has a component composition including 12 g trisodium methylglycinediacetic acid, 2 g crystalline layered sodium silicate, 1 g sodium hydrogen carbonate, 1.3 g PVA, 0.2 g CMC, 0.2 g protease, and 0.3 g sodium sulfite. The detergency ratio of the respective wet-type artificially stained fabrics and the respective EMPA stained fabrics was measured before and after washing with this washing liquid. The results are shown in Tables 6 and 7.

WORKING EXAMPLE 23

A washing liquid having a detergent concentration of 0.57 g/L and a pH of 10.5 was obtained by dissolving a total component amount of detergent of 17 g in 30 liters of the Japanese standard washing water where the detergent has a component composition including 15 g trisodium methylglycinediacetic acid, 1.3 g PVA, 0.2 g CMC, 0.2 g protease, and 0.3 g sodium sulfite. The detergency ratio of the respective wet-type artificially stained fabrics and the respective EMPA stained fabrics was measured before and after washing with this washing liquid. The results are shown in Tables 6 and 7.

COMPARATIVE EXAMPLE 8

As a comparative example of Working Examples 21 to 23, the detergency ratio of the respective wet-type artificially stained fabrics and the respective EMPA stained fabrics was measured before and after washing with a washing liquid obtained by dissolving a commercially available powdered synthetic detergent (Attack Bio Enzymes, detergent concentration 0.67 g/L, manufactured by Kao Corporation, enzymes and fluorescent brightening agent included) in 30 liters of the Japanese standard washing water at a standard concentration. The results are shown in Tables 6 and 7.

[Table 6]

TABLE 6

| | TOTAL AMOUNT/ CONCENTRATION OF DETERGENT (TOP: g/BOTTOM: g/L) | DETERGENT COMPOSITION (TOP: BLENDING AMOUNT (g)/BOTTOM: BLENDING RATIO (WT %)) | | | | |
|---|---|---|---|---|---|---|
| | | CHELATING AGENT | ALKALINE BUFFER | | ANTI-SOIL REDEPOSITION AGENT | |
| | | TRISODIUM METHYLGLYCINEDIACETIC ACID | CRYSTALLINE LAYERED SODIUM SILICATE | SODIUM HYDROGEN CARBONATE | PVA | CMC |
| WORKING | 17.0 | 10.0 | 3.5 | 1.5 | 1.3 | 0.2 |
| EXAMPLE 21 | 0.57 | 58.8 | 20.6 | 8.8 | 7.6 | 1.2 |
| WORKING | 17.0 | 12.0 | 2.0 | 1.0 | 1.3 | 0.2 |
| EXAMPLE 22 | 0.57 | 70.6 | 11.8 | 5.9 | 7.6 | 1.2 |
| WORKING | 17.0 | 15.0 | 0 | 0 | 1.3 | 0.2 |
| EXAMPLE 23 | 0.57 | 88.2 | 0 | 0 | 7.6 | 1.2 |
| COMPARATIVE | 20.0 | COMMERCIALLY AVAILABLE POWDERED SYNTHETIC DETERGENT | | | | |
| EXAMPLE 8 | 0.67 | (ATTACK BIO ENZYMES) | | | | |

| | DETERGENT COMPOSITION (TOP: BLENDING AMOUNT (g)/BOTTOM: BLENDING RATIO (WT %)) | | | | WASHING RATIO (%) |
|---|---|---|---|---|---|
| | ENZYME | | | | ARTIFICIALLY |
| | PROTEASE | SODIUM SULFITE | OTHER | pH | STAINED FABRIC |
| WORKING | 0.2 | 0.3 | 0 | 10.0 | 63.6 |
| EXAMPLE 21 | 1.2 | 1.8 | 0 | | |
| WORKING | 0.2 | 0.3 | 0 | 10.5 | 68.2 |
| EXAMPLE 22 | 1.2 | 1.8 | 0 | | |
| WORKING | 0.2 | 0.3 | 0 | 10.5 | 70.8 |
| EXAMPLE 23 | 1.2 | 1.8 | 0 | | |
| COMPARATIVE EXAMPLE 8 | ○ | | fluorescent brightening agent | 10.5 | 49.4 |

[Table 7]

TABLE 7

WASHING PERFORMANCE TEST RESULTS USING JAPANESE STANDARD WASHING WATER (HARDNESS: 90 PPM)

| | | | DETERGENCY (%) | | | | | | |
|---|---|---|---|---|---|---|---|---|---|
| | | | ARTIFICIALLY | EMPA STAINED FABRIC | | | | | |
| | TYPE | pH | STAINED FABRIC | 101 | 106 | 111 | 112 | 114 | 116 |
| WORKING EXAMPLE 21 | PREFERRED EMBODIMENT | 10.5 | 63.6 | 25.1 | 29.3 | 85.7 | 56.6 | 48.7 | 55.3 |
| WORKING EXAMPLE 22 | PREFERRED EMBODIMENT | 10.5 | 68.2 | 28.5 | 29.4 | 86.3 | 56.7 | 54.0 | 54.2 |
| WORKING EXAMPLE 23 | PREFERRED EMBODIMENT | 10.5 | 70.8 | 29.8 | 29.2 | 84.1 | 57.8 | 51.6 | 56.7 |
| COMPARATIVE EXAMPLE 8 | COMMERCIALLY AVAILABLE POWDERED SYNTHETIC DETERGENT | 10.5 | 49.4 | 24.7 | 22.8 | 82.4 | 36.1 | 23.7 | 45.6 |

(Second Detergency Test: Detergency Test Results and Review Thereof)

When comparing the detergency ratios of Working Examples 21 to 23 with that of Comparative Example 8, the washing liquids having the organic chelating agent according to the present invention as a main component for detergency show greater detergency ratios than the commercially available synthetic detergent having a surfactant as a main component for detergency.

Of these, Working Examples 21 to 23 is compared with Comparative Example 8 while referring to Table 7. As it can be seen from this comparison, the detergency ratios of Working Examples 21 to 23 show washing performance exceeding that of the conventional synthetic detergent for all types of soil such as synthetic sebum (artificially stained fabric), a mixture of mineral oil and carbon black (EMPA101), a mixture of olive oil and carbon black (EMPA106), blood (EMPA111), protein (EMPA112), red wine (EMPA114) and a mixture of blood, milk and carbon black (EMPA116), exhibiting an all-mighty detergency. Furthermore, as it can be seen from comparing Working Examples 21 to 23 with Comparison Example 8 in terms of detergent concentration, the detergent concentration is 0.57 g/L in Working Examples 21 to 23, and 0.67 g/L in Comparative Example 7. Even looking at usage amount of detergent, the usage amounts in Working Examples 21 to 23 were less than that of the commercially available powdered synthetic detergent of Comparative Example 8, and excellent in terms of washing performance and compactness. Note that when comparing Working Examples 21 to 23 while referring to Table 6, blending ratios of organic chelating agent are small in order of Working Examples 21, 22, and 23. Therefore, the composition of Working Example 21 should be employed when there is a request to reduce blending amount of organic matter in the detergent composition.

Next, as it can be seen from considering whether the washing liquids according to Working Examples 21 to 23 are those having an organic chelating agent as a main component for detergency, in any of Working Examples 21 to 23, trisodium methylglycinediacetic acid as the organic chelating agent occupies a blending ratio of 50% or more in the composition. Such blending ratio of 50% or more of trisodium methylglycinediacetic acid allows significant improvement in detergency (detergency ratio).

As a result, it can be said that the washing liquids according to Working Examples 21 to 23 are those having an organic chelating agent as a main component for detergency.

(Second Detergency Test: Summary)

In Working Examples 21 to 23 of the second detergency test, trisodium methylglycinediacetic acid (MGDA-3Na, maximum calcium trapping ability is 327 mg/g for pH 11) was used as the organic chelating agent. The calculated necessary amount of MGDA-3Na to completely destroy the hardness components included in the washing water (90 mg/L hardness components included, washing water amount: 1 liter) used in this test is found using the following expression.

$$90/327\times1\approx0.28\text{ g}$$

As it can be seen from referring to Table 6, the usage amount of MGDA-3Na is 0.33 g in Working Example 21, 0.4 g in Working Example 22, and 0.5 g in Working Example 23, and the range of usage amount of MGDA-3Na is 0.33 to 0.5 g (10 to 15 g if washing water amount is 30 liters). In any of the examples, an amount of organic chelating agent (MGDA-3Na) exceeding the calculated necessary amount (approximately 0.28 g) was used.

Next, preferred working examples of detergent compositions targeted to a market of a relatively high washing water hardness such as Europe are disclosed in a third detergency test while comparing to comparative examples.

Third Detergency Test

Test conditions are almost the same as those for the above-given first detergency test. To mention the differences for the third detergency test, a drum-type washing machine (W901, Cotton60 degrees C. course, load of 3 kg of towels) manufactured by Miele Co., Ltd. was used to wash according to the course program of the washing machine with 60 degrees Celsius washing water (water amount in a range of 15 to 20 liters) using substances and detergent concentrations given in the following working examples and comparative examples. Water having a hardness of 250 ppm is obtained by dissolving calcium chloride dihydrate in purified water, providing a concentration of 369 mg/L, and used as the washing water. Water obtained through such procedure is hereafter referred to as European standard washing water.

WORKING EXAMPLE 24

A washing liquid having a detergent concentration of 2.6 to 3.5 g/L and a pH of 10.0 was obtained by dissolving a total component amount of detergent of 52 g in 15 to 20 liters of the European standard washing water where the detergent has a component composition including 27 g trisodium methylglycinediacetic acid, 3 g sodium hydrogen carbonate, 2.6 g PVA, 0.4 g CMC, 1 g totalase as an enzyme, 0.5 g sodium sulfite as an enzyme stabilizing agent, 15 g sodium percarbonate as a bleaching agent, which is the remaining additive, and 2.5 g tetraacetyl ethylenediamine as an activating agent for the bleaching agent. The detergency ratio of the respective wet-type artificially stained fabrics and the respective EMPA stained fabrics was measured before and after washing with this washing liquid. The results are shown in Tables 8 and 9.

WORKING EXAMPLE 25

A washing liquid having a detergent concentration of 2.6 to 3.5 g/L and a pH of 10.0 was obtained by dissolving a total component amount of detergent of 52 g in 15 to 20 liters of the European standard washing water where the detergent has a component composition including 30 g trisodium methylglycinediacetic acid, 2.6 g PVA, 0.4 g CMC, 1 g totalase as an enzyme, 0.5 g sodium sulfite as an enzyme stabilizing agent, 15 g sodium percarbonate as a bleaching agent, which is the remaining additive, and 2.5 g tetraacetyl ethylenediamine as an activating agent for the bleaching agent. The detergency ratio of the respective wet-type artificially stained fabrics and the respective EMPA stained fabrics was measured before and after washing with this washing liquid. The results are shown in Tables 8 and 9.

COMPARATIVE EXAMPLE 9

As a comparative example of Working Examples 24 and 25, the detergency ratio of the respective wet-type artificially stained fabrics and the respective EMPA stained fabrics was measured before and after washing with a washing liquid obtained by dissolving a commercially available powdered synthetic detergent (Persil MEGAPERLS (registered trademark) Sensitiv, detergent concentration 3.8 to 5 g/L, manufactured by Henkel KGaA, zeolite and bleaching agent included) in 15 to 20 liters of the European standard washing water at a standard concentration. The results are shown in Tables 8 and 9.

[Table 8]

TABLE 8

| | TOTAL AMOUNT/ CONCENTRATION OF DETERGENT (TOP: g/BOTTOM: g/L) | DETERGENT COMPOSITION (TOP: BLENDING AMOUNT (g)/BOTTOM: BLENDING RATIO (WT %)) | | | | |
|---|---|---|---|---|---|---|
| | | CHELATING AGENT | ALKALINE BUFFER | | ANTI-SOIL REDEPOSITION AGENT | |
| | | TRISODIUM METHYLGLYCINEDIACETIC ACID | CRYSTALLINE LAYERED SODIUM SILICATE | SODIUM HYDROGEN CARBONATE | PVA | CMC |
| WORKING EXAMPLE 24 | 52.0 | 27.0 | 0 | 3.0 | 2.6 | 0.4 |
| | 2.6-3.5 | 51.9 | 0 | 5.8 | 5.0 | 0.8 |
| WORKING EXAMPLE 25 | 52.0 | 30.0 | 0 | 0 | 2.6 | 0.4 |
| | 2.6-3.5 | 57.7 | 0 | 0 | 5.0 | 0.8 |
| COMPARATIVE EXAMPLE 9 | 75.0 | COMMERCIALLY AVAILABLE POWDERED SYNTHETIC DETERGENT (PERSIL MEGAPERLS SENSITIV) | | | | |
| | 3.8-5.0 | | | | | |

| | DETERGENT COMPOSITION (TOP: BLENDING AMOUNT (g)/BOTTOM: BLENDING RATIO (WT %)) | | | | WASHING RATIO (%) |
|---|---|---|---|---|---|
| | ENZYME | | | | ARTIFICIALLY STAINED FABRIC |
| | TOTALASE | SODIUM SULFITE | OTHER | pH | |
| WORKING EXAMPLE 24 | 1.0 | 0.5 | 17.5 | 10.0 | 79.5 |
| | 1.9 | 1.0 | 33.7 | | |
| WORKING EXAMPLE 25 | 1.0 | 0.5 | 17.5 | 10.0 | 79.3 |
| | 1.9 | 1.0 | 33.7 | | |
| COMPARATIVE EXAMPLE 9 | AMYLASE/CELLULASE/ LIPASE/PROTEASE | | ZEOLITE/ BLEACHING AGENT | 9.8 | 76.0 |

[Table 9]

TABLE 9

| WASHING PERFORMANCE TEST RESULTS USING EUROPEAN STANDARD WASHING WATER (HARDNESS: 240 PPM) | | | | | | | | | |
|---|---|---|---|---|---|---|---|---|---|
| | | | DETERGENCY (%) | | | | | | |
| | | | ARTIFICIALLY | EMPA STAINED FABRIC | | | | | |
| | TYPE | pH | STAINED FABRIC | 101 | 106 | 111 | 112 | 114 | 116 |
| WORKING EXAMPLE 24 | PREFERRED EMBODIMENT | 10.0 | 79.5 | 63.1 | 63.7 | 104.6 | 83.1 | 90.9 | 60.4 |
| WORKING EXAMPLE 25 | PREFERRED EMBODIMENT | 10.0 | 79.3 | 64.8 | 67.9 | 109.6 | 82.7 | 93.8 | 59.9 |

TABLE 9-continued

| WASHING PERFORMANCE TEST RESULTS USING EUROPEAN STANDARD WASHING WATER (HARDNESS: 240 PPM) | | | | | | | | | |
|---|---|---|---|---|---|---|---|---|---|
| | | | DETERGENCY (%) | | | | | | |
| | | | ARTIFICIALLY | EMPA STAINED FABRIC | | | | | |
| | TYPE | pH | STAINED FABRIC | 101 | 106 | 111 | 112 | 114 | 116 |
| COMPARATIVE EXAMPLE 9 | COMMERCIALLY AVAILABLE POWDERED SYNTHETIC DETERGENT | 9.8 | 76.0 | 60.3 | 48.7 | 104.5 | 63.7 | 69.0 | 51.5 |

(Third Detergency Test: Detergency Test Results and Review Thereof)

When comparing the detergency ratios of Working Examples 24 and 25 with that of Comparative Example 9, the washing liquids having the organic chelating agent according to the present invention as a main component for detergency show detergency ratios equivalent to or greater than the commercially available synthetic detergent having a surfactant as a main component for detergency.

Of these, Working Examples 24 and 25 are compared with Comparative Example 9 while referring to Table 9. As it can be seen from this comparison, the detergency ratios of Working Examples 24 and 25 show washing performance exceeding that of the conventional synthetic detergent for all types of soil such as synthetic sebum (artificially stained fabric), a mixture of mineral oil and carbon black (EMPA101), a mixture of olive oil and carbon black (EMPA106), blood (EMPA111), protein (EMPA112), red wine (EMPA114) and a mixture of blood, milk and carbon black (EMPA116), exhibiting an all-mighty detergency. Furthermore, as it can be seen from comparing Working Examples 24 and 25 with Comparison Example 9 in terms of detergent concentration, the detergent concentration is 2.6 to 3.5 g/L in Working Examples 24 and 25, and 3.8 to 5 g/L in Comparative Example 9. Even looking at usage amount of detergent, 30% less than usage amount of the commercially available powdered synthetic detergent in Comparative Example 9 was used in Working Examples 24 and 25, and excellent in terms of washing performance and compactness. Note that when comparing Working Examples 24 and 25 while referring to Table 8, blending ratio of organic chelating agent is small in Working Example 24. Therefore, the composition of Working Example 24 should be employed when there is a request to reduce blending amount of organic matter in the detergent composition.

Next, as it can be seen from considering whether the washing liquids according to Working Examples 24 and 25 are those having an organic chelating agent as a main component for detergency, in either of Working Examples 24 and 25, trisodium methylglycinediacetic acid as the organic chelating agent occupies a blending ratio of 50% or more in the composition. Such blending ratio of 50% or more of trisodium methylglycinediacetic acid allows significant improvement in detergency (detergency ratio).

As a result, it can be said that the washing liquids according to Working Examples 24 and 25 are those having an organic chelating agent as a main component for detergency.

(Third Detergency Test: Summary)

In Working Examples 24 and 25 of the third detergency test, trisodium methylglycinediacetic acid (MGDA-3Na, maximum calcium trapping ability is 327 mg/g for pH 11) was used as the organic chelating agent. The calculated necessary amounts of MGDA-3Na to completely destroy the hardness components included in the washing water (250 mg/L hardness components included, washing water amount: 15 to 20 liters) used in this test are found using the following expression.

15 liters: 250/327×15=11.47 g 20 liters: 250/327×20=15.29 g

As it can be seen from referring to Table 8, the usage amount of MGDA-3Na is 27 g in Working Example 24 and 30 g in Working Example 25, and the range of usage amount of MGDA-3Na is 27 to 30 g. In either example, an amount of organic chelating agent (MGDA-3Na) exceeding the calculated necessary amount (approximately 15 g in the case of washing water amount of 20 liters), which is about double, was used.

(Specifying Chemicals Used)

The utilized chemicals disclosed in this specification were as follows:

1. Crystalline layered sodium silicate: Purifeed (manufactured by Tokuyama Siltech Co., Ltd.)
2. Sodium bicarbonate: Grade E (manufactured by Tokuyama Corporation)
3. Polyvinyl alcohol (PVA): POVAL JP-05S (manufactured by Japan VAM & Poval Co., Ltd.)
4. Carboxy methyl cellulose (CMC): Cellogen BSH-12 (manufactured by Dai-ichi Kogyo Seiyaku Co., Ltd.)
5. Enzyme: protease, Properase1000E (manufactured by Nagase ChemteX Corporation)
6. Enzyme: totalase (manufactured by Novozymes)
7. Enzyme stabilizing agent: sodium sulfite: purified sodium sulfite (manufactured by Daito Chemical Co., Ltd.)
8. Bleaching agent: sodium percarbonate (manufactured by Asahi Denka Kogyo K.K.)
9. Bleach activating agent: tetraacetyl ethylenediamine (manufactured by Clariant (Japan) K.K.)
10. Tetrasodium ethylene diamine tetraacetic acid (EDTA-4Na): Trilon B powder (registered trademark, manufactured by BASF Corporation)
11. Trisodium methylglycinediacetic acid (MGDA-3Na): Trilon M powder (registered trademark, manufactured by BASF Corporation)

INDUSTRIAL APPLICABILITY

A detergent composition of the present invention, which uses an organic chelating agent as a main component for detergency and uses no surfactant, has detergency and usability equivalent to or greater than that of conventional synthetic detergents, which use a surfactant as a main ingredient.

The present invention described above clearly has many diversifications being within the scope of equivalency. All modifications that will become obvious to those skilled in the art are included in the technical scope of the claims according to the present invention without such diversifications being considered as departing from the spirit and scope of the present invention.

The invention claimed is:

1. A detergent composition for clothes, which is phosphate-free and surfactant-free but includes a washing component comprising:

A) an organic chelating agent which is an organic alkaline chelating agent or a sodium salt of the organic chelating agent as a substance having a hardness component trapping ability selected from the group consisting of:

1) Methyl Glycine Diacetic Acid (MGDA),
2) Dicarboxymethyl Glumatic Acid (GLDA),
3) Aspartate Diacetic Acid (ASDA),
4) Ethylenediamine Disuccinic Acid (EDDS),
5) Hydroxy Iminodisuccinic Acid (HIDS),
6) Iminodisuccinic Acid (IDS), or mixtures thereof;

B) an anti-soil redeposition agent that prevents resoiling of hydrophilic fibers and hydrophobic fibers, which is a water-soluble polymer substance of a non-ionic system including at least one species selected from the group consisting of an acetyl group, a methoxy group, a hydroxypropyl group, a poly-oxy propylene group, or mixtures thereof as the hydrophobic group, and including a hydroxyl group as the hydrophilic group; and wherein, when the detergent composition is dissolved in a concentration of 0.5 to 10.5 g/L, the washing liquid meets the following criteria:

i) the washing liquid has a pH of 9 to 11 provided by at least one of the organic chelating agent and an alkaline buffer; and ii) more than enough organic chelating agent, or combination of the organic chelating agent and the alkaline buffer having a hardness component trapping ability exists within the washing liquid such that the concentration of a hardness component within the washing liquid is 10 ppm or less; and the washing liquid further includes an oxy-based bleaching agent.

2. A clothes washing method for washing clothes using a washing liquid, which is obtained by dissolving a detergent composition which is phosphate-free and surfactant-free but includes a washing component comprising:

A) an organic chelating agent or a sodium salt of the organic chelating agent as a substance having a hardness component trapping ability selected from the group consisting of:

1) Methyl Glycine Diacetic Acid (MGDA),
2) Dicarboxymethyl Glumatic Acid (GLDA),
3) Aspartate Diacetic Acid (ASDA),
4) Ethylenediamine Disuccinic Acid (EDDS),
5) Hydroxy Iminodisuccinic Acid (HIDS),
6) Iminodisuccinic Acid (IDS), or mixtures thereof;

B) an anti-soil redeposition agent that prevents resoiling of hydrophilic fibers and hydrophobic fibers, which is a water-soluble polymer substance of a non-ionic system including at least one species selected from the group consisting of an acetyl group, a methoxy group, a hydroxypropyl group, a poly-oxy propylene group, or mixtures thereof as the hydrophobic group, and including a hydroxyl group as the hydrophilic group; and C) an alkaline buffer selected from the group consisting of:

1) a carbonate alkali metal salt,
2) a silicate alkali metal salt,
3) a carbonate alkali metal salt and bicarbonate alkali metal salt,
4) a bicarbonate alkali metal salt and silicate alkali metal salt,
5) a carbonate alkali metal salt and silicate alkali metal salt, or mixtures thereof;

comprising washing clothes in a solution of the washing component;

wherein, when the detergent composition is dissolved in a concentration of 0.5 to 10.5 g/L, the washing liquid meets the following criteria:

i) the washing liquid has a pH of 9 to 11 provided by at least one of the organic chelating agent and the alkaline buffer; and ii) more than enough organic chelating agent, or combination of organic chelating agent and alkaline buffer exists within the washing liquid such that a concentration of a hardness component within the washing liquid is 10 ppm or less.

3. The clothes washing method of claim 2, wherein when clothing is put therein, said washing liquid satisfies a washing condition that more than enough of a substance, which has a hardness component trapping ability for destroying the hardness component within the washing liquid, exists in the washing liquid such that the hardness component is completely destroyed.

4. The clothes washing method of claim 2, wherein the chelating agent satisfies the condition that the maximum calcium trapping ability (number of milligrams of $CaCO_3$ per 1 g for pH 11) is 200 mg/g or greater.

5. The clothes washing method of claim 2, wherein the alkaline buffer is a crystalline layered alkali metal silicate salt.

6. The clothes washing method of claim 5, wherein the substance having a hardness component trapping ability is a mixture of the chelating agent and the crystalline layered alkali metal silicate salt.

7. The clothes washing method of claim 2, wherein the washing liquid further comprises a washing enzyme and a reducing agent for inhibiting deactivation of the enzyme.

8. The clothes washing method of claim 2, wherein the washing liquid further comprises an oxy-based bleaching agent.

9. A detergent composition for clothes, which is phosphate-free and surfactant-free but includes a washing component comprising:

A) an organic chelating agent which is an organic non-alkaline chelating agent or a sodium salt of the organic chelating agent as a substance having a hardness component trapping ability selected from the group consisting of:

1) Methyl Glycine Diacetic Acid (MGDA),
2) Dicarboxymethyl Glumatic Acid (GLDA),
3) Aspartate Diacetic Acid (ASDA),
4) Ethylenediamine Disuccinic Acid (EDDS),
5) Hydroxy Iminodisuccinic Acid (HIDS),
6) Iminodisuccinic Acid (IDS), or mixtures thereof;

B) an anti-soil redeposition agent that prevents resoiling of hydrophilic fibers and hydrophobic fibers, which is a water-soluble polymer substance of a non-ionic system including at least one species selected from the group consisting of an acetyl group, a methoxy group, a hydroxypropyl group, a poly-oxy propylene group, or mixtures thereof as the hydrophobic group, and including a hydroxyl group as the hydrophilic group; and C) alkaline buffer selected from the group consisting of:

1) carbonate alkali metal salt, 2) silicate alkali metal salt, 3) carbonate alkali metal salt and bicarbonate alkali metal salt, 4) bicarbonate alkali metal salt and silicate alkali metal salt, 5) carbonate alkali metal salt and silicate alkali metal salt, or mixtures thereof;

wherein, when the detergent composition is dissolved in a concentration of 0.5 to 10.5 g/L, the washing liquid meets the following criteria:

i) the washing liquid has a pH of 9 to 11 provided by at least one of the organic chelating agent and an alkaline buffer; and ii) more than enough organic chelating agent, or combination of the organic chelating agent and the alkaline buffer having a hardness component trapping ability exists within the washing liquid such that the concentration of a hardness component within the washing liquid is 10 ppm or less.

10. The detergent composition for clothes of claim 9, wherein the chelating agent satisfies condition that a maximum calcium trapping ability (number of milligrams of $CaCO_3$ per 1 g for pH 11) is 300 mg/g or greater.

* * * * *